US007089152B2

(12) United States Patent
Oda et al.

(10) Patent No.: US 7,089,152 B2
(45) Date of Patent: Aug. 8, 2006

(54) SYSTEM AND METHOD FOR ASSISTING SHOE SELECTION

(75) Inventors: Takao Oda, Osaka (JP); Natsuki Sato, Osaka (JP); Isao Nakano, Osaka (JP); Yasunori Kaneko, Osaka (JP); Tomohiro Ota, Osaka (JP)

(73) Assignee: Mizuno Corporation, Osaka (JP)

( * ) Notice: Subject to any disclaimer, the term of this patent is extended or adjusted under 35 U.S.C. 154(b) by 209 days.

(21) Appl. No.: 10/871,505

(22) Filed: Jun. 18, 2004

(65) Prior Publication Data

US 2005/0049816 A1 Mar. 3, 2005

(30) Foreign Application Priority Data

Jun. 19, 2003 (JP) ..... 2003-175042

(51) Int. Cl.
*G06F 19/00* (2006.01)
*A61B 5/103* (2006.01)

(52) U.S. Cl. ..... 702/182; 702/155; 702/159; 382/128; 600/592

(58) Field of Classification Search ..... None
See application file for complete search history.

(56) References Cited

U.S. PATENT DOCUMENTS 5,123,169 A * 6/1992 White et al. ..... 33/6
5,128,880 A * 7/1992 White ..... 382/165
5,164,793 A * 11/1992 Wolfersberger et al. .... 356/607
5,195,030 A * 3/1993 White ..... 705/26
5,206,804 A * 4/1993 Thies et al. ..... 705/27
5,216,594 A * 6/1993 White et al. ..... 705/28
5,231,723 A * 8/1993 White et al. ..... 12/133 R
5,237,520 A * 8/1993 White ..... 382/154
5,339,252 A * 8/1994 White et al. ..... 700/98
5,361,133 A * 11/1994 Brown et al. ..... 356/612
5,515,268 A * 5/1996 Yoda ..... 705/26
5,539,677 A * 7/1996 Smith ..... 705/26
5,640,779 A * 6/1997 Rolloff et al. ..... 33/514.2
5,659,395 A * 8/1997 Brown et al. ..... 356/601
5,671,055 A * 9/1997 Whittlesey et al. ..... 356/602
5,689,446 A * 11/1997 Sundman et al. ..... 702/167
5,712,803 A * 1/1998 Garuet-Lempirou ..... 702/158
5,714,098 A * 2/1998 Potter ..... 264/40.1
5,726,898 A * 3/1998 Jacobs ..... 700/231
5,753,931 A * 5/1998 Borchers et al. ..... 250/559.22
5,790,256 A * 8/1998 Brown et al. ..... 356/613
5,879,725 A * 3/1999 Potter ..... 425/403

(Continued)

FOREIGN PATENT DOCUMENTS

EP 0 531 289 2/1994

(Continued)

*Primary Examiner*—Patrick J. Assouad
(74) *Attorney, Agent, or Firm*—Hamre, Schumann, Mueller & Larson, P.C.

(57) ABSTRACT

A system for assisting shoe selection can select and present a shoe type that fits a customer by estimating the anatomical characteristics of a foot from the state of the foot. The system includes the following: a measured data input portion for measuring and inputting data that show the state of a foot of a person to be measured; a normalization processing portion for normalizing the data input from the measured data input portion and storing the normalized data at least temporarily; a shoe catalog database for storing information of a plurality of types of shoes; and a selection portion for estimating the anatomical characteristics of the foot of the person based on the normalized data, referring to the shoe catalog database based on the anatomical characteristics, and selecting and presenting a shoe type that fits the person.

26 Claims, 25 Drawing Sheets

U.S. PATENT DOCUMENTS

| | | | | |
|---|---|---|---|---|
| 6,246,994 | B1 * | 6/2001 | Wolven et al. | 702/14 |
| 6,289,107 | B1 * | 9/2001 | Borchers et al. | 382/100 |
| 6,463,351 | B1 * | 10/2002 | Clynch | 700/163 |
| 6,546,356 | B1 * | 4/2003 | Genest | 702/153 |
| 6,583,792 | B1 * | 6/2003 | Agnew | 345/660 |
| 6,601,042 | B1 * | 7/2003 | Lyden | 705/26 |
| 6,654,705 | B1 * | 11/2003 | Benson et al. | 702/168 |
| 6,741,728 | B1 * | 5/2004 | Genest | 382/115 |
| 6,879,945 | B1 * | 4/2005 | Cook | 703/2 |
| 6,939,502 | B1 * | 9/2005 | Lyden | 264/496 |
| 2003/0001314 | A1 * | 1/2003 | Lyden | 264/494 |
| 2003/0051372 | A1 * | 3/2003 | Lyden | 36/27 |
| 2003/0069807 | A1 * | 4/2003 | Lyden | 705/26 |
| 2004/0193075 | A1 * | 9/2004 | Martindale | 600/592 |
| 2005/0071935 | A1 * | 4/2005 | Shah et al. | 12/146 L |

FOREIGN PATENT DOCUMENTS

| | | |
|---|---|---|
| JP | 2001-207 | 1/2001 |
| JP | 3025530 | 1/2001 |
| JP | 2001-104005 | 4/2001 |
| JP | 2001-275716 | 10/2001 |
| JP | 2002-177015 | 6/2002 |
| JP | 2002-199905 | 7/2002 |

* cited by examiner

Standard sole image

Sensitivity map of arch height

Sensitivity map of arch rigidity

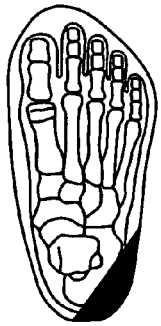
FIG. 11A
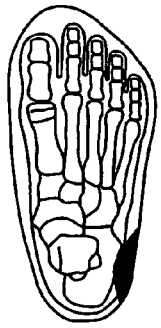
FIG. 11B
| | Soft | Medium | Hard |
|---|---|---|---|
| High arch | 0 | -1 | -2 |
| Medium arch | 1 | 0 | -1 |
| Low arch | 2 | 1 | 0 |
FIG. 12
| | Soft | Medium | Hard |
|---|---|---|---|
| High arch | 0 | 1 | 2 |
| Medium arch | -1 | 0 | 1 |
| Low arch | -2 | -1 | 0 |
FIG. 13

SYSTEM AND METHOD FOR ASSISTING SHOE SELECTION

TECHNICAL FIELD

The present invention relates to a shoe selection assisting system that selects and presents a shoe type that fits a customer when the customer selects shoes. In particular, the present invention relates to a shoe selection assisting system that estimates the anatomical characteristics of a foot of the customer from the state of the foot.

BACKGROUND ART

In shoe stores or the like, a system is known that measures the foot shape of a customer with measuring equipment and selects shoes suitable for the customer.

As an example of such a conventional system, JP 2002-199905 A proposes a system that measures foot shape data of a customer by using a three-dimensional foot shape measuring device and extracts a trial shoe model that is matched with or close to the foot shape data.

JP 2001-275716 A proposes a method for providing walking shoes that fit each person's feet. In this method, a foot printer or the like is located on a plane that is inclined at the same angle as the inclination angle of a shoe that a person tries. Then, the plantar pressure distribution or the arch shape of the foot of the person is examined on the plane, and an insole is inserted in accordance with the examination.

Moreover, Japanese Patent No. 3025530 proposes a system that uses a foot scanner unit to generate three-dimensional phase electronic images of feet, thereby selecting appropriate footwear for a user.

In general, shoes are mass-produced, except for, e.g., the athletic shoes that are designed specifically for top athletes. On the other hand, the foot shape differs significantly between individuals. Therefore, even if the foot shape of each person can be measured precisely in a three-dimensional fashion of the above conventional systems, it is very difficult to determine the right shoes appropriately for each person because there are various factors such as foot length, width, and instep height.

DISCLOSURE OF INVENTION

Therefore, with the foregoing in mind, it is an object of the present invention to provide a shoe selection assisting system that can select and present a shoe type that fits a customer by measuring the state of a foot and estimating the anatomical characteristics of the foot in accordance with the measurement.

A system for assisting shoe selection of the present invention includes the following: a measured data input portion for measuring and inputting data that show the state of a foot of a person to be measured; a normalization processing portion for normalizing the data input from the measured data input portion and storing the normalized data at least temporarily; a shoe information storage portion for storing information of a plurality of types of shoes; and a selection portion for estimating the anatomical characteristics of the foot of the person based on the normalized data, referring to the shoe information storage portion based on the anatomical characteristics, and selecting and presenting a shoe type that fits the person. The selection portion estimates at least one selected from an arch height ratio and flexibility of the foot as the anatomical characteristics.

A method for assisting shoe selection of the present invention includes the following steps: measuring data that show the state of a foot of a person to be measured; normalizing the data that show the state of the foot; estimating at least one selected from an arch height ratio and flexibility of the foot as the anatomical characteristics of the foot of the person based on the normalized data; and selecting and presenting a shoe type that fits the person by referring to a shoe information storage portion based on the anatomical characteristics.

A program product of the present invention includes a computer program recorded on a recording medium. The computer program allows a computer to execute the following steps: inputting data that show the state of a foot of a person to be measured; normalizing the data that show the state of the foot; estimating at least one selected from an arch height ratio and flexibility of the foot as the anatomical characteristics of the foot of the person based on the normalized data; and selecting and presenting a shoe type that fits the person by referring to a shoe information storage portion based on the anatomical characteristics.

BRIEF DESCRIPTION OF DRAWINGS

FIGS. 11A and 11B are diagrams for explaining an example of a shoe type selected in accordance with a foot type.

FIG. 12 is a table for explaining an example of over pronation risk factors.

FIG. 13 is a table for explaining an example of impact exposure risk factors.

FIG. 18A illustrates a low-arch foot, and FIG. 18B illustrates a high-arch foot.

FIG. 19A illustrates a soft foot, and FIG. 19B illustrates a hard foot.

FIG. 20A illustrates a low-arch foot, FIG. 20B illustrates a medium-arch foot.

FIG. 21A illustrates a soft foot, and FIG. 21B illustrates a hard foot.

EMBODIMENT OF INVENTION

Figure 1:
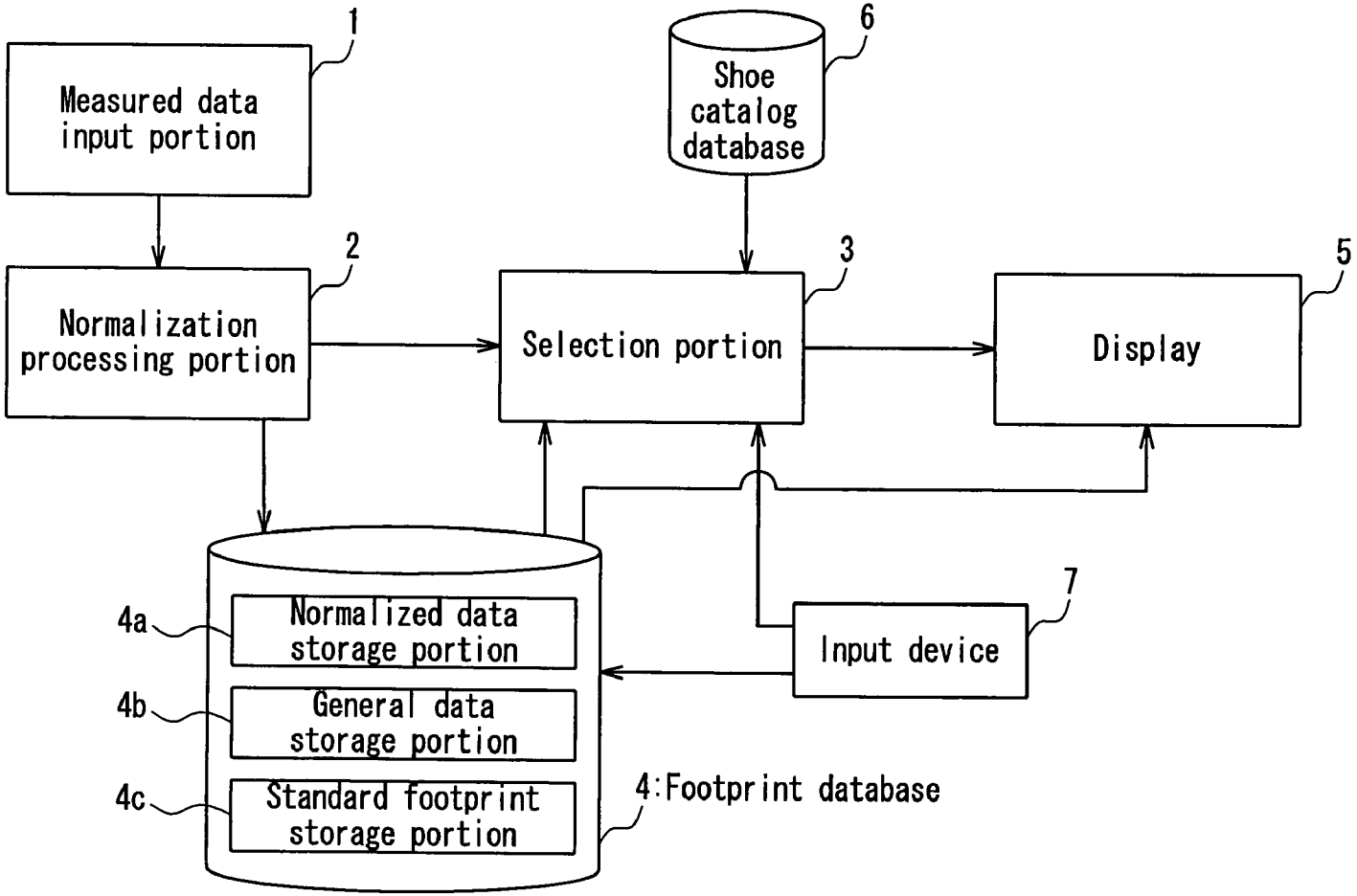
FIG. 1 is a block diagram showing the schematic configuration of a shoe selection assisting system of Embodiment 1 of the present invention.

In the shoe selection assisting system of the present invention, it is preferable that the measured data input portion measures the state of the sole of the foot on the ground while the person is standing still by using at least one selected from an optical sensor and a pressure sensor. Alternatively, it is preferable that as the state of the foot of the person, the measured data input portion measures a three-dimensional shape of the foot of the person by using an optical sensor.

The shoe selection assisting system further may include a standard data storage portion for storing standard data that show the state of a standard foot. It is preferable that the selection portion estimates the anatomical characteristics of the foot of the person based on a comparison of the normalized data and the standard data.

In the shoe selection assisting system, it is preferable that the selection portion decides whether a load applied to the heel of the person tends to be eccentric inward or outward based on the normalized data, and selects a shoe type that fits the person by further considering the eccentric tendency.

In the shoe selection assisting system, it is preferable that the selection portion estimates both the arch height ratio and the flexibility of the foot as the anatomical characteristics, decides a risk of injury to the foot of the person based on a combination of the estimated arch height ratio and flexibility, and selects a shoe type in accordance with the risk of injury.

In this case, it is useful that the selection portion decides an over pronation level of ankle joints of the person based on the combination of the arch height ratio and the flexibility, and selects a shoe type with higher stability as the over pronation level increases. Alternatively, it is useful that the selection portion decides an impact exposure level of ankle joints of the person based on the combination of the arch height ratio and the flexibility, and selects a shoe type with higher cushioning properties as the impact exposure level increases.

In the shoe selection assisting system, the selection portion may estimate the anatomical characteristics of the foot of the person by multivariate analysis. Also, the selection portion may estimate the anatomical characteristics of the foot of the person by using a neural network.

In the shoe selection assisting system, it is preferable that the selection portion selects a shoe type that fits the person based on sole performance. The sole performance can be categorized by a material and/or a shape of parts that are contained in or formed on a midsole of a shoe. Also, the sole performance can be categorized by a material and/or a shape of parts that constitute a midsole of a shoe. The parts are preferably in the form of a corrugate plate.

In the shoe selection assisting system, the selection portion may select a shoe type that fits the person along with an insole that fits the person. In this case, the selection portion may select the insole separately for the left foot and the right foot of the person.

The shoe selection assisting system further may include the following: a characteristic input portion for inputting data concerning the person that include data showing the anatomical characteristics of the foot of the person; a normalized data storage portion for storing the normalized data obtained from the normalization processing portion in correspondence with the anatomical characteristics input from the characteristics input portion; a standard data generation portion for generating foot type-specific standard data that show the standard state of a sole on the ground in accordance with classification of the anatomical characteristics by using the normalized data stored in the normalized data storage portion; and a foot type-specific standard data storage portion for storing the foot type-specific standard data generated by the standard data generation portion.

In the above embodiment, it is preferable that the data concerning the person input from the characteristic input portion include as the anatomical characteristics of the foot at least one selected from the group consisting of a measured value of foot length, a measured value of navicular tuberosity height, an arch height ratio, a measured value of maximum supination angle, a measured value of maximum pronation angle, foot flexibility, an ankle joint movement range, a Q-angle value, and a valgus angle of the big toe or the little toe.

The shoe selection assisting system further may include a standard data presentation portion for displaying or printing the foot type-specific standard data stored in the foot type-specific standard data storage portion so that the foot type-specific standard data are compared with the normalized data obtained from the normalization processing portion.

The shoe selection assisting system further may include the following: a display and input portion for displaying the normalized data obtained from the normalization processing portion as an image and for inputting the coordinates of a point that is designated by an operator and operating instructions on the display image of the normalized data; and a feature extraction portion for determining a feature value to estimate the anatomical characteristics of the foot of the person based on the coordinates of the point designated on the display image of the normalized data by the display and input portion. It is preferable that the selection portion estimates the anatomical characteristics of the foot of the person in accordance with the feature value that is obtained from the normalized data by the feature extraction portion.

In the shoe selection assisting system, at least two selected from the measured data input portion, the normalization processing portion, and the selection portion may be connected via the Internet.

In the shoe selection assisting system, it is preferable that the selection portion presents a shoe type that fits the person and information concerning the shoe or the anatomical characteristics of the foot of the person.

Hereinafter, more specific embodiments of the present invention will be described with reference to the drawings.

Embodiment 1

Embodiment 1 of the present invention will be described below by referring to the drawings.

FIG. 1 is a block diagram showing the schematic configuration of a shoe selection assisting system of this embodiment. The shoe selection assisting system of this embodiment can be installed, e.g., in a shoe specialty store or shoe counter. The shoe selection assisting system includes a measured data input portion 1, a normalization processing portion 2, a selection portion 3, a footprint database 4, a display 5, a shoe catalog database (shoe information storage portion) 6, and an input device 7. The footprint database 4, which will be described in detail later, includes a normalized data storage portion 4*a*, a general data storage portion 4*b*, and a standard footprint storage portion 4*c*.

The measured data input portion 1 measures data that show the state of a sole on the ground while a customer (person to be measured) is standing still. The measured data input portion 1 may include, e.g., an optical sensor that is provided on the bottom side of a foot support made of transparent plate. When a customer stands on the foot support, the optical sensor scans the sole of the foot. Thus, the measured data input portion 1 optically can measure the state of the sole on the ground. Alternatively, a CCD camera or digital camera may be arranged on the bottom side of the foot support to take a picture of the state of the sole on the ground. The measured data input portion 1 also may use a foot support in which pressure sensors are embedded throughout the surface. The pressure sensors can detect pressure distribution of the foot of a customer standing on the foot support, thereby measuring the state of the sole on the ground. When the pressure sensors are used, it is preferable that at least one sensor is embedded in an area of 1 $cm^2$. The pressure sensors may be either a resistance-change-type sensor or a capacity-change-type sensor. Moreover, the state of the sole on the ground may be measured by using both the optical and pressure sensors.

The result of the measurement with the optical and/or pressure sensors is transmitted to the normalization processing portion 2 as data (footprint data) that show the state of the sole on the ground two-dimensionally (visually). For the optical sensor, the footprint data are in the form of brightness distribution. For the pressure sensor, the footprint data are in the form of pressure distribution. The measurement of the state of the sole on the ground can be performed on either or both of the customer's feet. In the case of both feet, it is possible to measure one foot at a time or both feet simultaneously. When the state of the sole on the ground is measured by the measured data input portion 1, bare feet are preferred in view of accuracy. However, the customer also can wear socks or the like.

Figure 2:
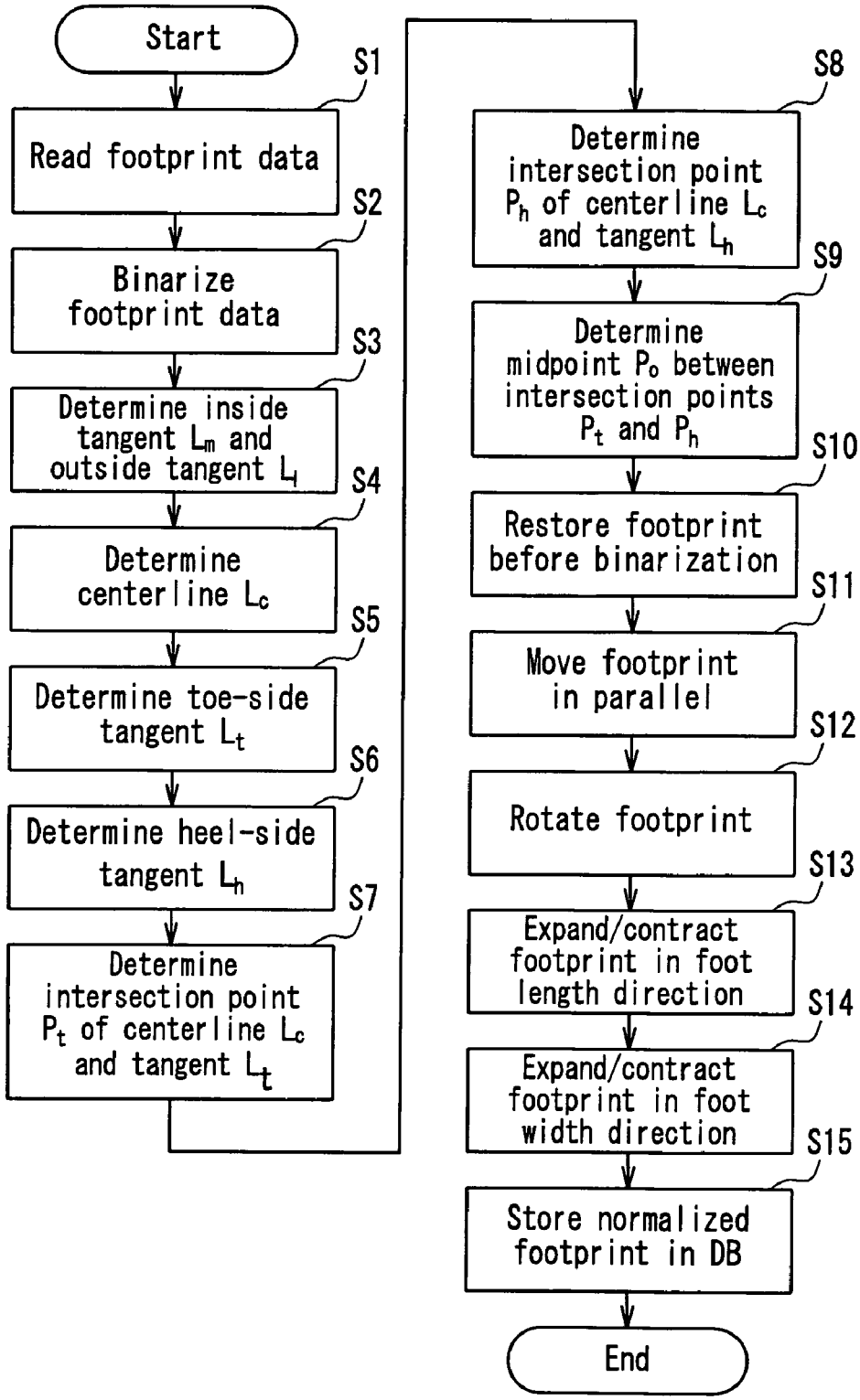
FIG. 2 is a flow chart showing an example of a normalization process of a footprint in the shoe selection assisting system of Embodiment 1.

The normalization processing portion 2 normalizes the data that have been input from the measured data input portion 1 and stores the normalized data at least temporarily. An example of the normalization process in the normalization processing portion 2 will be described by referring to FIGS. 2 and 3. FIG. 2 is a flow chart showing an example of the normalization process in the normalization processing portion 2.

Figure 3:
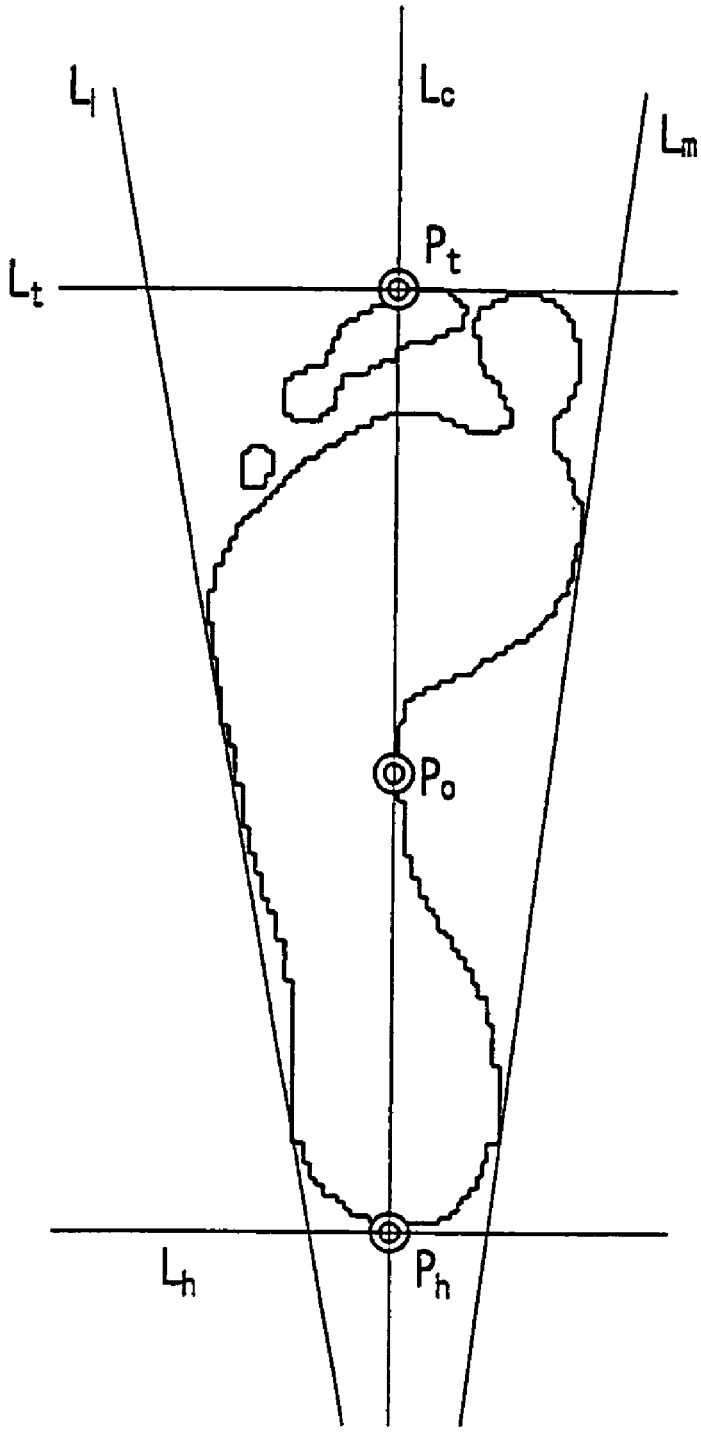
FIG. 3 is a diagram for explaining the normalization process of a footprint.

As shown in FIG. 2 first, the normalization processing portion 2 reads footprint data from the measured data input portion 1 (step S1), and then converts the footprint data into binary data using a predetermined threshold value (step S2). The threshold value of the step S2 may be determined beforehand or adjusted in accordance with the measurement conditions. For example, when the state of the sole on the ground is measured by an optical sensor, the threshold value may be adjusted in accordance with color or the like of the socks that the customer wears. The binarization of the step S2 can provide, e.g., footprint data as shown in FIG. 3.

Next, with the binary footprint data, the normalization processing portion 2 determines an inside tangent $L_m$ and an outside tangent $L_l$ of the foot (step S3), and further determines a centerline $L_c$ that divides the angle between the inside tangent $L_m$ and the outside tangent $L_l$ into two equal parts (step S4). Then, the normalization processing portion 2 determines a toe-side tangent $L_t$ and a heel-side tangent $L_h$ that are perpendicular to the centerline $L_c$ (steps S5 and S6). Subsequently, the normalization processing portion 2 determines an intersection point $P_t$ of the centerline $L_c$ and the tangent $L_t$ and an intersection point $P_h$ of the centerline $L_c$ and the tangent $L_h$ (steps S7 and S8). Moreover, the normalization processing portion 2 determines a midpoint $P_o$ between the intersection points $P_t$ and $P_h$ (step S9). After completion of the above processes, the binary footprint is restored to its original footprint (step S10).

Next, the normalization processing portion 2 moves the restored footprint in parallel so that the midpoint $P_o$ coincides substantially with the center of the sole (step S11).

Further, the normalization processing portion 2 rotates the footprint around the midpoint $P_o$ as an origin (center) so that the centerline $L_c$ becomes a vertical line (step S12). Then, the normalization processing portion 2 expands or contracts the footprint in the foot length direction ($L_c$ direction) by 250/L times while fixing the midpoint $P_o$ (step S13). L represents a foot length (mm). The value of the foot length L may be either measured with the optical or pressure sensors of the measured data input portion 1, or input by a customer, a salesclerk, or a shoe fitter using the input device 7. The normalization processing portion 2 further expands or contracts the footprint in the foot width direction (the direction perpendicular to $L_c$) by $\alpha$ times while fixing the midpoint $P_o$ (step S14). In this case, $\alpha$ can be obtained by $$\alpha=102/((12\times(L-250)/50)+102)$$

where L is the foot length (mm). The formula for determining α is used as a grading example of Japanese adults. Therefore, it is also possible to use different formulas, taking into account various viewpoints such as age bracket and races.

By performing the steps S1 to S14, normalized footprint data (normalized data) can be provided. The normalized footprint data are transmitted from the normalization processing portion 2 to the footprint database 4, and then are stored in the normalized data storage portion 4*a* (step S15). When the normalized footprint data are stored in the normalized data storage portion 4*a*, various data concerning the customer (e.g., the name, address, telephone number, e-mail address, purchasing history, preference for shoes, or foot injury history) may be input from the input device 7 and stored in the general data storage portion 4*b* of the footprint database 4 so as to have a correspondence with the normalized footprint data.

Next, the function of the selection portion 3 will be described by referring to FIGS. 4 and 5. The selection portion 3 receives the normalized footprint of the customer from the normalization processing portion 2 and compares it with a standard footprint stored in the standard footprint storage portion 4*c* of the footprint database 4. Thus, the selection portion 3 estimates the anatomical characteristics of the foot of the customer, and then selects and presents a shoe type suitable for the customer.

Figure 4A:
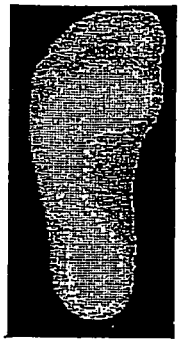
FIG. 4A is a photograph showing an example of a standard footprint.

FIG. 4A shows an example of the standard footprint. It is preferable that an average footprint is obtained statistically from an appropriately selected population and is used as the standard footprint, although the standard footprint is not limited thereto. In this embodiment, the standard footprint is stored previously in the standard footprint storage portion 4*c* of the footprint database 4. As the standard footprint, e.g., two or more types of footprints that are obtained from each of the populations by specific properties such as gender, age, race, and sports may be stored in the standard footprint storage portion 4*c* and used in accordance with the customer.

Figure 5:
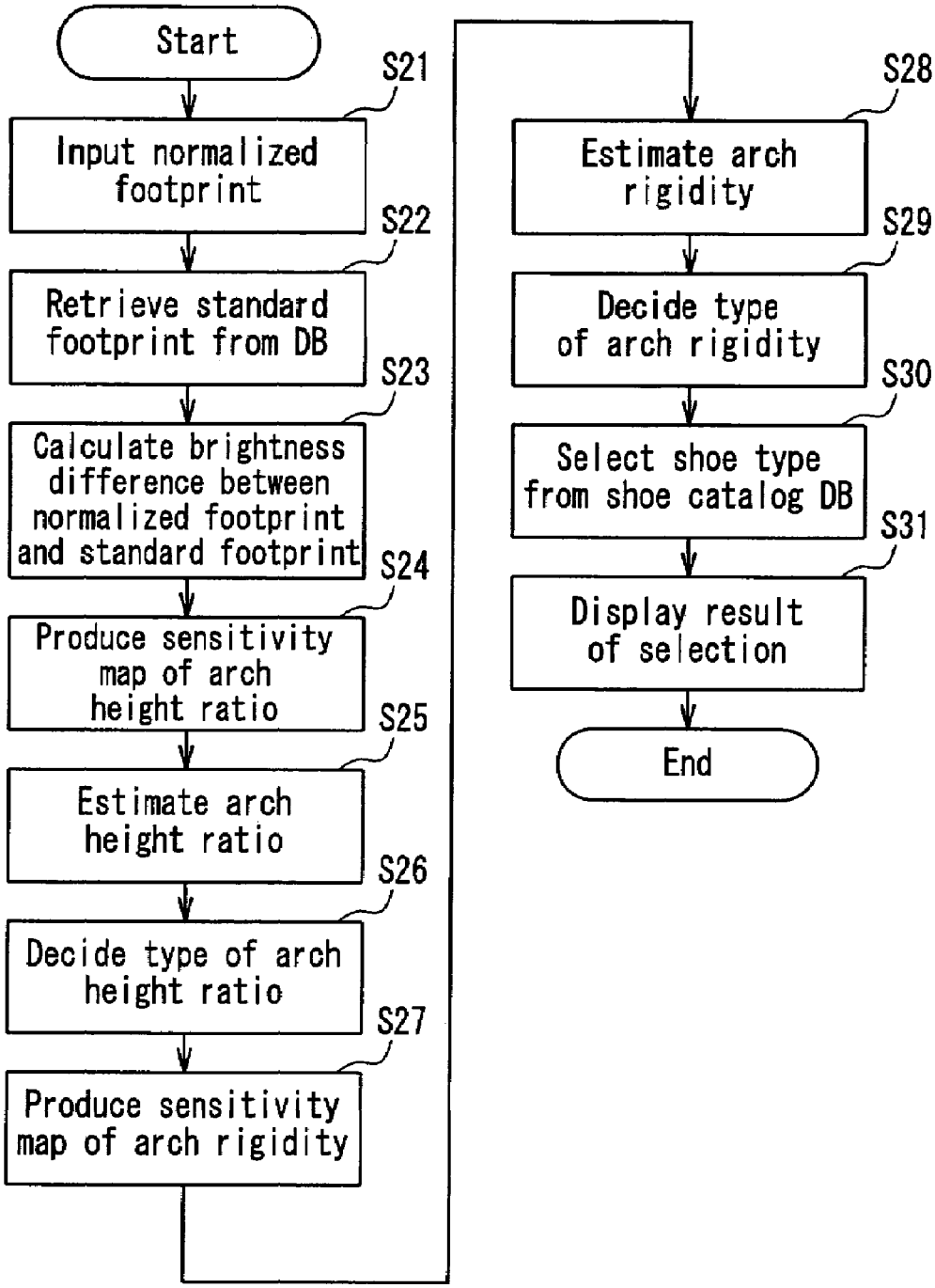
FIG. 5 is a flow chart showing an example of a process of a selection portion in the shoe selection assisting system of Embodiment 1.

FIG. 5 is a flow chart showing an example of a process of the selection portion 3. In this case, the footprint is in the form of brightness distribution. However, even if the footprint is in the form of pressure distribution, the same process can be performed. The selection portion 3 receives the normalized footprint of the customer from the normalization processing portion 2 (step S21), retrieves a standard footprint from the standard footprint storage portion 4*c* (step S22), and calculates a difference in brightness per pixel between the normalized footprint and the standard footprint (step S23).

Then, the selection portion 3 produces a sensitivity map of an arch height ratio using the brightness difference in the step S23 (step S24) and estimates (calculates) an arch height ratio based on the sensitivity map (step S25).

Figure 4B:
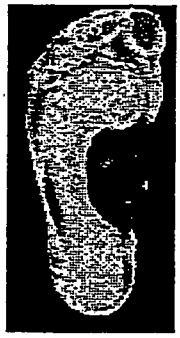
FIG. 4B is a photograph showing an example of a sensitivity map of an arch height ratio.

The sensitivity map of an arch height ratio may be a map as shown in FIG. 4B. This sensitivity map can be produced in such a manner that a tendency of the relationship between the image brightness of a footprint and the arch height ratio is obtained from the population and analyzed statistically, and weight based on the tendency or weight for each region provided in the learning process of a neural network is determined per region of the foot.

Figure 6:
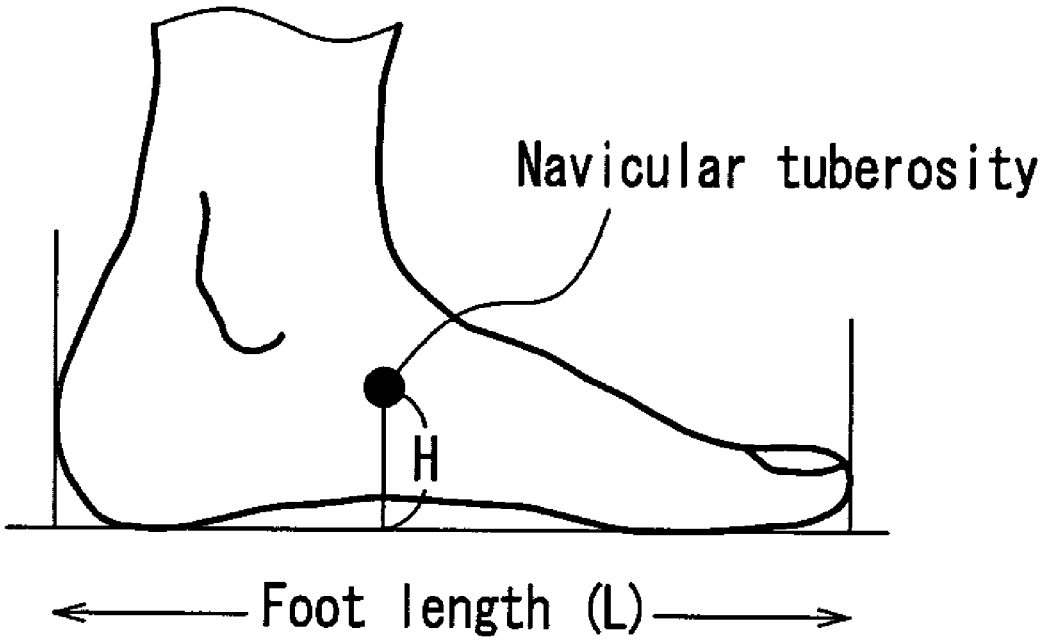
FIG. 6 is a diagram for explaining a method for calculating an arch height ratio.

In general, as shown in FIG. 6, the arch height ratio is determined by measuring a foot length L and a navicular tuberosity height H, and calculating a ratio (H/L) of the height H to the length L. However, the selection portion 3 of this embodiment can calculate a difference in image brightness per pixel between the footprint derived from the sensitivity map of an arch height ratio and the standard footprint, obtain a sum of products of the differences over the entire area of the sensitivity map, and thus estimate a value of the arch height ratio without measuring the foot length L and the navicular tuberosity height H.

The selection portion 3 decides which categories of "high arch", "medium arch", and "low arch (flatfoot)" the foot of the customer belongs to, based on the arch height ratio that has been estimated in the step S25 (step S26). When the arch height ratio is, e.g., not less than 22% for men and not less than 20% for women, the foot is classified as "high arch". When the arch height ratio is, e.g., not more than 15% for men and not more than 13% for women, the foot is classified as "low arch". When the arch height ratio is out of these ranges, the foot is classified as "medium arch". The classification thresholds of the arch height ratio in this embodiment are merely an example, and the present invention is not limited thereto.

Next, the selection portion 3 produces a sensitivity map of arch rigidity (foot flexibility) using the brightness difference in the step S23 (step S27) and estimates (calculates) arch rigidity based on the sensitivity map (step S28).

Figure 4C:
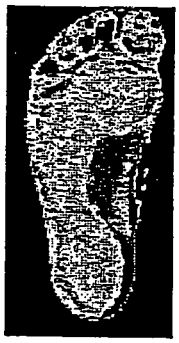
FIG. 4C is a photograph showing an example of a sensitivity map of arch rigidity.

The sensitivity map of arch rigidity may be a map as shown in FIG. 4C. This sensitivity map can be produced in such a manner that a tendency of the relationship between the image brightness of a footprint and the arch rigidity is obtained from the population and analyzed statistically, and weight based on the tendency or weight for each region provided in the learning process of a neural network is determined per region of the foot.

In general, the arch rigidity is determined quantitatively by measuring a change in navicular tuberosity height under weight-bearing and non-weight-bearing conditions, and dividing the change by the foot length. However, the selection portion 3 of this embodiment can calculate a difference in image brightness per pixel between the footprint derived from the sensitivity map of arch rigidity and the standard footprint, obtain a sum of products of the differences over the entire area of the sensitivity map, and thus estimates a value of the arch rigidity without relying on actual observations of the foot.

The selection portion 3 decides which categories of "hard", "medium", and "soft" the foot of the customer belongs to, based on the arch rigidity that has been estimated in the step S28 (step S29).

By performing the steps S21 to S29, the selection portion 3 classifies the anatomical characteristics of the foot of the customer into three types of "high arch", "medium arch", and "low arch (flatfoot)" according to the "arch height ratio" and further into three types of "hard", "medium", and "soft" according to the "arch rigidity (foot flexibility)". In this embodiment, therefore, the foot of the customer can be classified as any one of 3×3=9 types depending on the combination of the arch height ratio and the arch rigidity.

A method for classifying the anatomical characteristics of the foot in the present invention is not limited to the above specific example, and they may be classified by any characteristics that can be estimated from the state of the sole on the ground. For example, the classification may be performed according to only the arch height ratio in the steps S21 to S26. Alternatively, the classification may be performed according to only the arch rigidity in the steps S25 to S29 after the steps S21 to S23 while skipping the steps S24 to S26.

In this embodiment, the selection portion 3 selects a shoe type that fits the customer from the shoe catalog database 6 based on the arch height ratio that has been decided in the step S26 and the arch rigidity that has been decided in the step S29 (step S30), and then displays the result of the selection on the display 5 (step S31). The selection portion 3 may select either only one type of shoes that is expected to best fit the customer or a plurality of types of shoes, and outputs them for display.

The shoe catalog database 6 previously stores the information of shoe types that correspond to each of the classified foot types in the selection portion 3. In this embodiment, e.g., when the selection portion 3 classifies the anatomical characteristics of the foot of the customer into a total of 9 types depending on the combination of the arch height ratio (3 types) and the arch rigidity (3 types), the information of shoe types (referred to as shoe type information in the following) that correspond to at least each of the 9 types is stored previously in the shoe catalog database 6.

The shoe type information may include, e.g., the product number, type number, product name, and additional information of shoes. Examples of the additional information include the functional properties, effects, and price of the shoes, the information about a game or game level for the shoes, and the information about a place where the shoes are used. Moreover, the additional information may be expressed in any data formats such as text, voice data, static data, and dynamic data. The additional information can be displayed at the time that the selected shoe type is presented to the customer, thereby improving the customer service further.

The shoe type information is not limited to the information for identifying the shoes as a product, and also may include the shoe last number or the types of shoe parts. The "shoe parts" may include, e.g., an outer sole, insole, midsole, upper, and various cushioning materials.

When the shoe selection assisting system of this embodiment is used in a shoe store where a shoemaker provides many different product lines by appropriately combining two or more types of shoe parts that are prepared for each foot type, it is possible to select shoes with parts suitable for the customer from those product lines. Thus, the customer service can be improved further. Moreover, it is also possible to select parts suitable for the customer by using the shoe selection assisting system in a shoe store and to place a full or custom order with the shoemaker.

When a shoemaker provides one or more types of shoe main bodies that are designed according to the broad classification of foot types and optional parts (e.g., an insole) that are inserted into a shoe main body according to the detailed classification of foot types, the shoe selection assisting system of this embodiment may be used to select the combination of the shoe main body and the optional parts.

For example, a person whose arch rigidity is judged as "hard" is susceptible to shock when the heel strikes the ground because of low flexibility of the foot. In this case, one possible selection is as follows. Two types of shoe main bodies are prepared: one having particularly high cushioning properties for a person with "hard" arch, and the other having standard cushioning properties for a person with "medium" or "soft" arch, and the adaptability of an arch height ratio is adjusted by a variation in shape or thickness of the parts such as an insole and midsole.

An example of a method for selecting shoes in accordance with a foot type by the selection portion 3 will be described below.

Figure 7A:
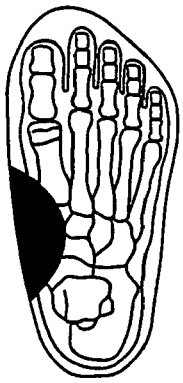
FIGS. 7A to 7E are diagrams for explaining an example of a shoe type selected in accordance with a foot type.

For a person whose arch height ratio is judged as "high arch", it is preferable that the inside of a shoe is formed so as to keep the medial longitudinal arch portion of the foot in its high arch shape. Therefore, the selection portion 3 recognizes, e.g., a shoe (or the combination of a shoe main body and optional parts) in which a portion filled with black as shown in FIG. 7A is made thicker than that of a normal shoe as a candidate for selection from the shoe catalog database 6.

In contrast, for a person whose arch height ratio is judged as "low arch (fatfoot)", it is preferable that the inside of a shoe is formed so as to keep the medial longitudinal arch portion of the foot in its low arch shape. Therefore, the selection portion 3 recognizes, e.g., a shoe (or the combination of a shoe main body and optional parts) in which a portion filled with black as shown in FIG. 7A is made thinner than that of a normal shoe as a candidate for selection from the shoe catalog database 6.

Figure 7B:
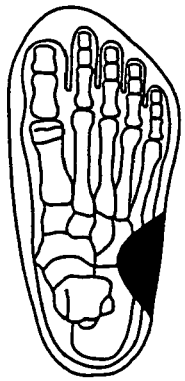
Figure 7C:
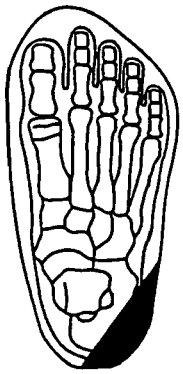

A person whose arch rigidity is judged as "hard" is prone to an inversion ankle sprain. To avoid such an injury, examples of a candidate for selection from the shoe catalog database 6 are as follows: a shoe in which a portion filled with black as shown in FIG. 7B is formed so as to maintain the lateral longitudinal arch portion of the foot; a shoe in which a portion filled with black as shown in FIG. 7C is formed so that weight is shifted easily to the inside of the foot after the heel strikes the ground; and a shoe having a combined configuration of those in FIGS. 7B and 7C. Note that the candidate for selection is not limited to the shoe itself, and also may include, e.g., the combination of a shoe main body and optional parts.

Figure 7D:
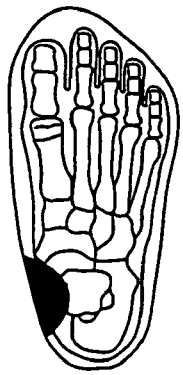
Figure 7E:
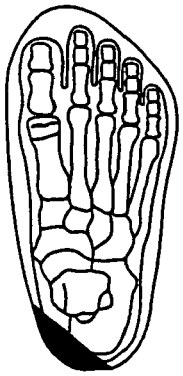

A person whose arch rigidity is judged as "soft" is prone to over pronation immediately after the heel strikes the ground. To avoid such an injury, examples of a candidate for selection from the shoe catalog database 6 are as follows: a shoe in which a portion filled with black as shown in FIG. 7D is formed so as to suppress an inward turning of the talus; a shoe in which a portion filled with black as shown in FIG. 7E is formed so that weight is shifted easily to the outside of the foot after the heel strikes the ground; and a shoe having a combined configuration of those in FIGS. 7D and 7E. Note that the candidate for selection is not limited to the shoe itself, and also may include, e.g., the combination of a shoe main body and optional parts.

Figure 8:
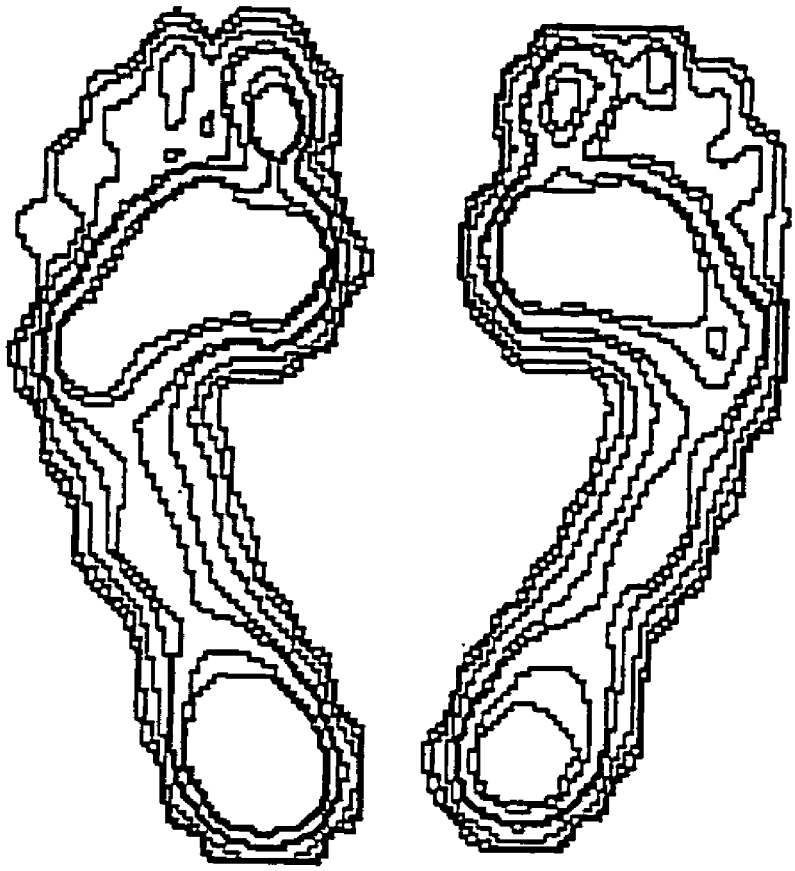
FIG. 8 shows an example of a contour map of pressure distribution on a footprint.

The selection portion 3 can select any shoe type by considering not only the arch height ratio and the arch rigidity, but also other anatomical characteristics. The other anatomical characteristics may include, e.g., the inward or outward eccentric tendency of a load applied to the heel. The selection portion 3 can decide whether the load applied to the heel tends to be eccentric inward or outward by producing a contour map of pressure distribution as shown in FIG. 8 from the normalized footprint, and evaluating on which side (inside or outside) of the heel the contour lines are spaced closely.

Figure 9A:
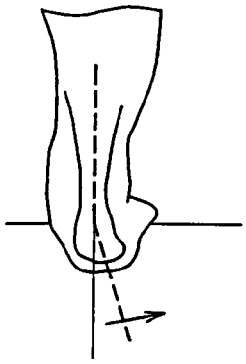
FIG. 9A is a diagram for explaining a foot in which a load applied to the heel is eccentric inward.
Figure 10A:
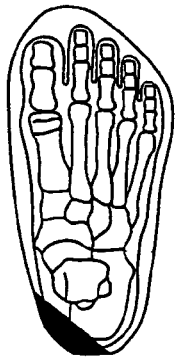
FIGS. 10A to 10C are diagrams for explaining an example of a shoe type selected in accordance with a foot type.
Figure 10B:
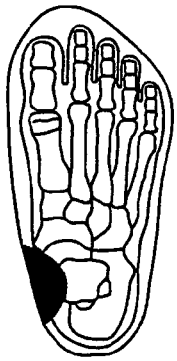
Figure 10C:
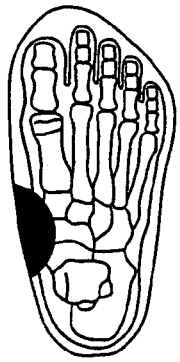

When the load applied to the heel is found to be eccentric inward, the heel portion may pronate (turn inward) as shown in FIG. 9A. Since weight is likely to be placed on the inside of the sole of this foot, the inner sole of the shoe wears easily, and the upper also tends to tilt inward. Moreover, the inward eccentricity of the load may cause over pronation. To avoid such an injury, it is preferable that a shoe has the function of shifting the eccentric load easily to the outside of the foot after the heel strikes the ground. Therefore, among the candidates that have been selected according to the arch height ratio and the arch rigidity, the selection portion 3 recognizes a shoe in which a portion filled with black as shown in FIG. 10A is made thicker than that of a normal shoe as a candidate for selection from the shoe catalog database 6. Alternatively, a shoe in which a portion filled with black as shown in FIG. 10B is made thicker than that of a normal shoe is useful to suppress an inward turning of the talus. Moreover, a shoe in which a portion filled with black as shown in FIG. 10C is made thicker than that of a normal shoe is useful to maintain the whole medial longitudinal arch portion while suppressing the inward turning. Further, a shoe obtained by combining at least two configurations in FIGS. 10A to 10C is useful as well. Note that the candidate for selection is not limited to the shoe itself, and also may include, e.g., the combination of a shoe main body and optional parts.

Figure 9B:
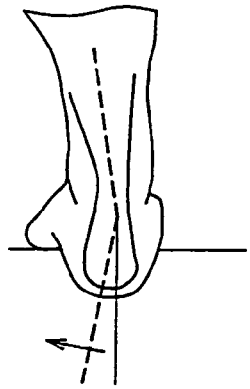
FIG. 9B is a diagram for explaining a foot in which a load applied to the heel is eccentric outward.

In contrast, when the load applied to the heel is found to be eccentric outward, the heel portion may supinate (turn outward) as shown in FIG. 9B. Since weight is likely to be placed on the outside of the sole of this foot, the outer sole of the shoe wears easily, and the upper also tends to tilt outward. Moreover, the outward eccentricity of the load may cause over supination. To avoid such an injury, it is preferable that a shoe has the function of shifting the eccentric load easily to the inside of the foot after the heel strikes the ground. Therefore, among the candidates that have been selected according to the arch height ratio and the arch rigidity, the selection portion 3 recognizes a shoe in which a portion filled with black as shown in FIG. 11A is made thicker than that of a normal shoe as a candidate for selection from the shoe catalog database 6. Alternatively, a shoe in which a portion filled with black as shown in FIG. 11B is made thicker than that of a normal shoe is useful to maintain the whole lateral longitudinal arch portion while suppressing an inversion ankle sprain. Moreover, a shoe obtained by combining the configurations in FIGS. 11A and 11B is useful as well. Note that the candidate for selection is not limited to the shoe itself, and also may include, e.g., the combination of a shoe main body and optional parts.

A method for selecting a shoe type of the present invention is not limited to the above specific examples. There also may be another method that includes deciding a risk of injury to the foot of a customer based on the combination of the arch height ratio and the arch rigidity, and selecting a shoe type in accordance with the risk of injury.

In this case, the selection portion 3 calculates, e.g., an over pronation risk factor (FIG. 12) as the risk of injury based on the type of arch height ratio and the type of arch rigidity that have been decided in the steps S26 and S29 in FIG. 5, respectively. When the arch height ratio is indicated by −1 for "high arch", 0 for "medium arch", and 1 for "low arch", and the arch rigidity is indicated by −1 for "hard", 0 for "medium", and 1 for "soft", the over pronation risk factor can be obtained by adding the points in each of the combinations, as shown in FIG. 12. The selection portion 3 selects a shoe (or optional parts) with higher stability from the shoe catalog database 6 as the value of the over pronation risk factor increases.

In addition to the over pronation risk factor, an impact exposure risk factor (FIG. 13) also may be used as the risk of injury. When the arch height ratio is indicated by 1 for "high arch", 0 for "medium arch", and −1 for "low arch", and the arch rigidity is indicated by 1 for "hard", 0 for "medium", and −1 for "soft", the impact exposure risk factor can be obtained by adding the points in each of the combinations, as shown in FIG. 13. The selection portion 3 selects a shoe (or optional parts) with higher cushioning properties from the shoe catalog database 6 as the value of the impact exposure risk factor increases.

A specific example of the shoe types stored in the shoe catalog database 6 will be described below. The following explanation is merely an example, and the present invention is not limited thereto.

Figure 14A:
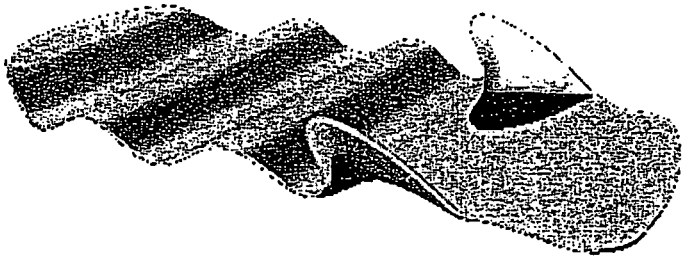
FIGS. 14A to 14C are perspective views showing an example of parts in the form of a corrugated plate that are used for a midsole.
Figure 14B:
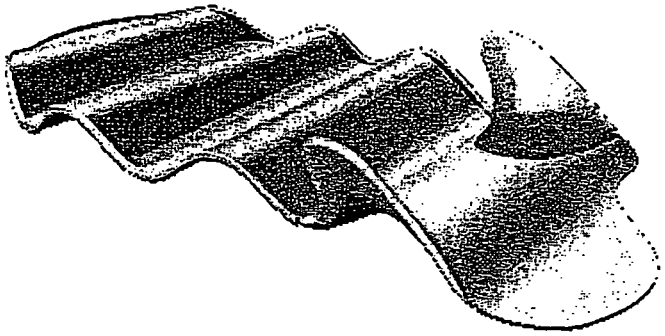
Figure 14C:
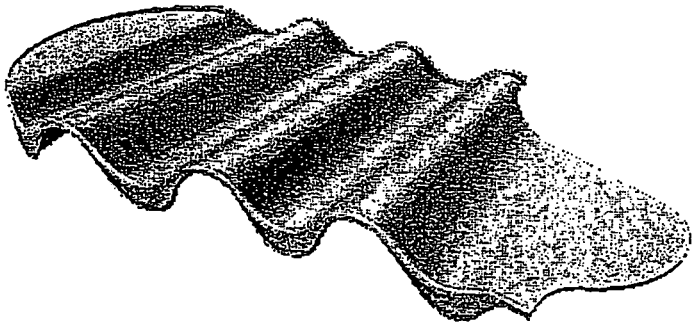

The dependence of shoe performance on sole performance is relatively large. Therefore, it is preferable that the shoe types in the shoe catalog database 6 are classified mainly by the sole performance. Moreover, it is known that the desired sole performance can be obtained by appropriately designing the material and/or shape of parts that constitute a midsole of the shoe or parts that are contained in or formed on the midsole. For example, when parts in the form of a corrugated plate as shown in FIGS. 14A to 14C are used as a midsole itself or as a part that is contained in or formed on the midsole, it is possible to provide shoes that exhibit performance according to the foot type. The parts in FIGS. 14A to 14C differ from one another, e.g., in material, mass, wave number, wave height, wave amplitude, or wave intervals on the inside and the outside. The parts in FIGS. 14A to 14C are used for a left foot, and the left side of the drawing corresponds to the heel side. The part in FIG. 14A has the highest cushioning properties, and the part in FIG. 14C has the highest stability. For the part in FIG. 14A, waves are formed at substantially regular intervals. Thus, this part is suitable for a foot characterized by "high arch" and "hard". For the part in FIG. 14B, the wave amplitude is slightly larger on the inside than that on the outside, and the wave interval is larger on the inside than that on the outside of the foot. Thus, this part is suitable for a foot characterized by "medium arch" and "medium" rigidity. For the part in FIG. 14C, the wave amplitude is the same as that of the part in FIG. 14B, and a second plate having a smaller width than the whole width of the foot is arranged on the underside of the plate (first plate) that appears on the surface in FIG. 14C. The second plate is arranged along the inside edge of the first plate, as shown in FIG. 14C. Therefore, the thickness of the part in FIG. 14C is made larger in the arch portion than that on the outside of the foot because the first and second plates are superimposed. Thus, this part is suitable for a foot characterized by "low arch" and "soft". Moreover, the parts in FIGS. 14A and 14B include a raised portion on both sides of the heel to suppress supination or pronation of the heel.

As described above, the normalization processing portion 2 normalizes a footprint, and the selection portion 3 estimates the anatomical characteristics of the foot based on the normalized footprint. According to this embodiment, therefore, the anatomical characteristics of the foot of a customer can be determined more precisely.

In this embodiment, a procedure is shown by the flow chart in FIG. 2 as an example of the normalization process. However, the normalization process of the present invention is not limited to the specific example in FIG. 2. Any process of "normalization" may be performed in the present invention, as long as a footprint that has been measured by the measured data input portion is processed to the extent that the footprint can be compared with the standard footprint or the anatomical characteristics of the foot can be estimated.

In this embodiment, the result of the selection by the selection portion 3 is output on the display. Also, the result of the selection may be output by printing. The same is true in the following embodiments.

In this embodiment, it is preferable that the selection portion 3 estimates a foot type by multivariate analysis or neural network. With the multivariate analysis, the input may be either a brightness matrix or a pressure matrix, while the output may include an arch height ratio and arch rigidity or the eccentricity of a load applied to the heel. With the neural network, fewer input items are required as in the case of the multivariate analysis because it aims to make a decision with higher precision and less input.

Embodiment 2

A shoe selection assisting system of Embodiment 2 of the present invention will be described below.

Figure 15:
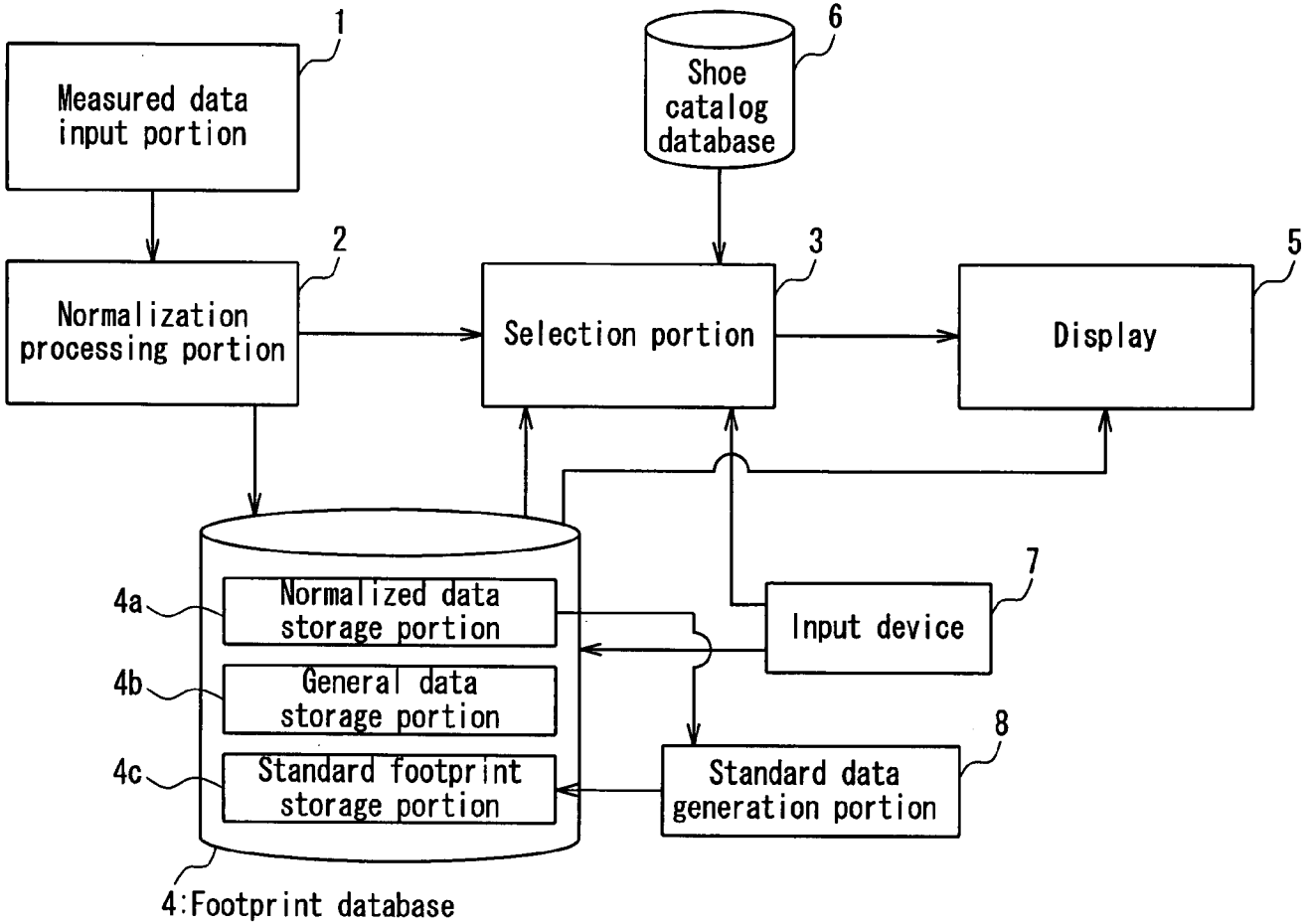
FIG. 15 is a block diagram showing the schematic configuration of a shoe selection assisting system of Embodiment 2 of the present invention.

As shown in FIG. 15, the shoe selection assisting system of this embodiment includes a standard data generation portion 8 in addition to the configuration of the shoe selection assisting system of Embodiment 1. In Embodiment 1, a statistically obtained standard footprint is stored previously in the standard footprint storage portion 4*c* of the footprint database 4. In Embodiment 2, the standard data generation portion 8 generates a foot type-specific standard footprint from the normalized footprint that is produced by the normalization processing portion 2 and stored in the normalized data storage portion 4*a*.

In the shoe selection assisting system of this embodiment, therefore, a clerk or shoe fitter actually measures a foot length L and a navicular tuberosity height H of a customer and inputs them with the input device 7 (characteristic input portion) whenever the customer selects shoes. The measurements (or H/L calculated from the measurements) are transmitted from the input device 7 to the footprint database 4, and then are stored in the general data storage portion 4*b* so as to have a correspondence with the normalized footprint data of the customer. Moreover, the clerk or shoe fitter inputs observations about the foot flexibility of the customer. These observations also are stored in the general data storage portion 4*b* in correspondence with the normalized footprint data. Thus, the footprint database 4 of this embodiment stores the normalized footprint data along with the information showing the actual foot type (anatomical characteristics) of the customer.

In this case, the foot type data input from the input device 7 preferably include at least one selected from the following: a measured value of foot length; a measured value of navicular tuberosity height; an arch height ratio; a measured value of maximum supination angle; a measured value of maximum pronation angle; foot flexibility; an ankle joint movement range; a Q-angle value; and a valgus angle of the big toe or the little toe. In addition to the foot type data, general data concerning the customer such as height, weight, body fat percentage, gender, kind of exercises that the customer ordinarily does, disease information, age, nationality, or biochemical information may be input and stored in the general data storage portion 4*b* of the footprint database 4 in correspondence with the normalized footprint data. Consequently, the statistics or classification of footprints also can be provided based on any items of the general data.

The standard data generation portion 8 makes access to the footprint database 4 at predetermined intervals or by external instructions, and extracts the normalized footprint data that are stored in the normalized data storage portion 4*a*. Then, the standard data generation portion 8 classifies the extracted normalized footprint data according to the actual foot type, processes the normalized footprint data statistically by foot type, and thus generates foot type-specific standard footprints. The foot type-specific standard footprints are transmitted from the standard data generation portion 8 to the standard footprint storage portion 4*c*, and then are stored in regions (not shown) by foot type.

As described above, the normalized footprints that have been stored in the normalized data storage portion are processed statistically by actual foot type, so that foot type-specific standard footprints are generated. Therefore, this embodiment can improve the foot type estimation accuracy based on the normalized footprints.

The foot type-specific footprints may be classified further to generate standard footprints by gender, age, race, sports, or the like.

Embodiment 3

A shoe selection assisting system of Embodiment 3 of the present invention will be described below.

In Embodiment 1, the selection portion 3 decides the foot type of a customer automatically by comparing the normalized footprint with the standard footprint. The shoe selection assisting system of this embodiment is substantially the same as Embodiment 1 in configuration, but different in function of the selection portion 3. That is, the selection portion 3 of this embodiment allows the footprint (normalized footprint) of the customer and foot type-specific standard footprints to be displayed on the display 5 (standard data presentation portion) so that these footprints can be compared. Then, a clerk, a shoe fitter, or the customer oneself selects and inputs which foot type the customer has by using the input device 7. Subsequently, the selection portion 3 selects shoes that fit the input foot type.

Figure 16:
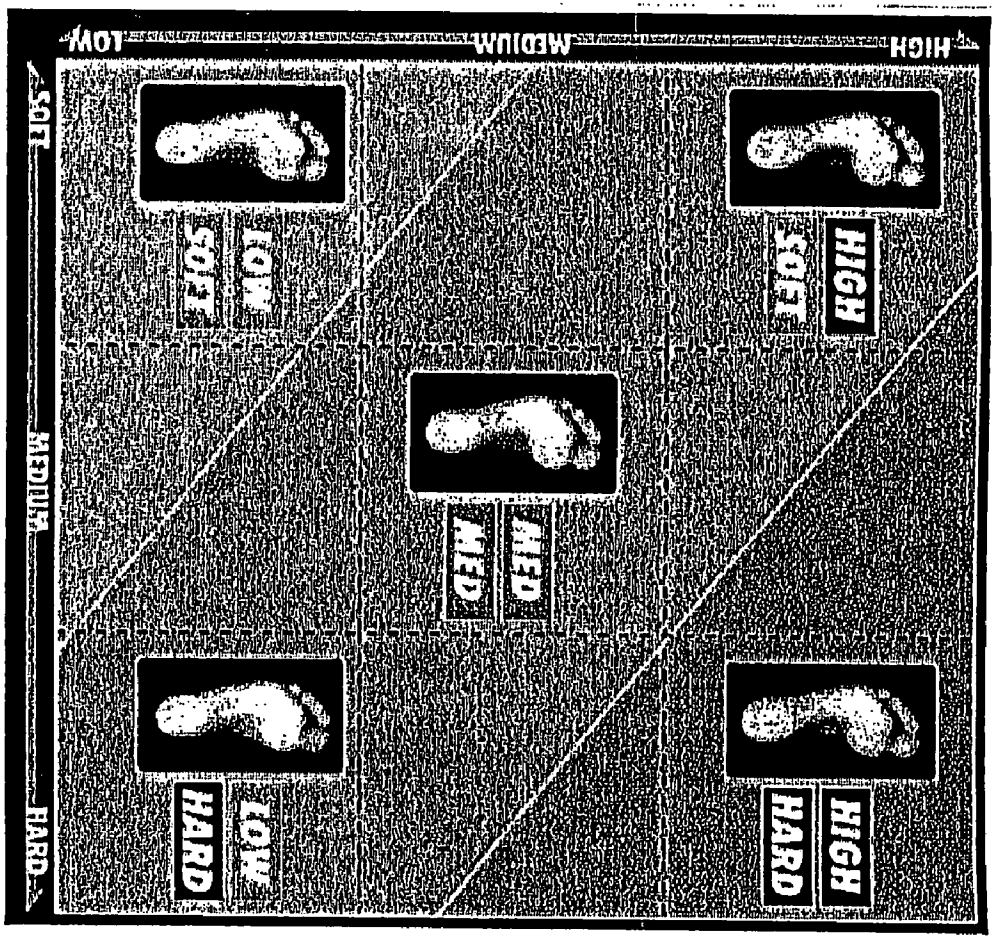
FIG. 16 shows an example of how to display foot type-specific standard footprints in a shoe selection assisting system of Embodiment 3 of the present invention.

FIG. 16 shows an example of how to display the foot type-specific standard footprints. In this example, the foot types are classified into a total of 9 categories depending on the arch height ratio (3 levels: low, medium, and high) and the arch rigidity (3 levels: soft, medium, hard), and the corresponding standard footprints are arranged. The classification and designation of the foot types are not limited to this specific example, and may be determined in accordance with the types of shoes and optional parts offered by shoemakers. For example, the foot types also may be classified into a total of 15 categories with 3 levels for the arch height ratio and 5 levels for the arch rigidity.

The footprint (normalized footprint) of the customer and the standard footprints can be displayed in any fashion, as long as these footprints are compared. For example, the screen of the display 5 may be divided into two or more viewing areas, thereby displaying the normalized footprint and the standard footprints of all foot types next to each other at the same time. Alternatively, the standard footprints may be displayed one by one so that the standard footprint is arranged next to the normalized footprint or overlapped with the normalized footprint. Moreover, the normalized footprint and the standard footprints may be printed rather than displayed so that these footprints can be compared.

As described above, the shoe selection assisting system of this embodiment provides an opportunity to select the foot type of a customer by displaying or printing the footprint (normalized footprint) of the customer and the standard footprints so that these footprints can be compared. In this case, the footprint of the customer is normalized and thus can be compared easily with the standard footprints. Therefore, the foot type of the customer can be determined more precisely.

Embodiment 4

A shoe selection assisting system of Embodiment 4 of the present invention will be described below.

Figure 17:
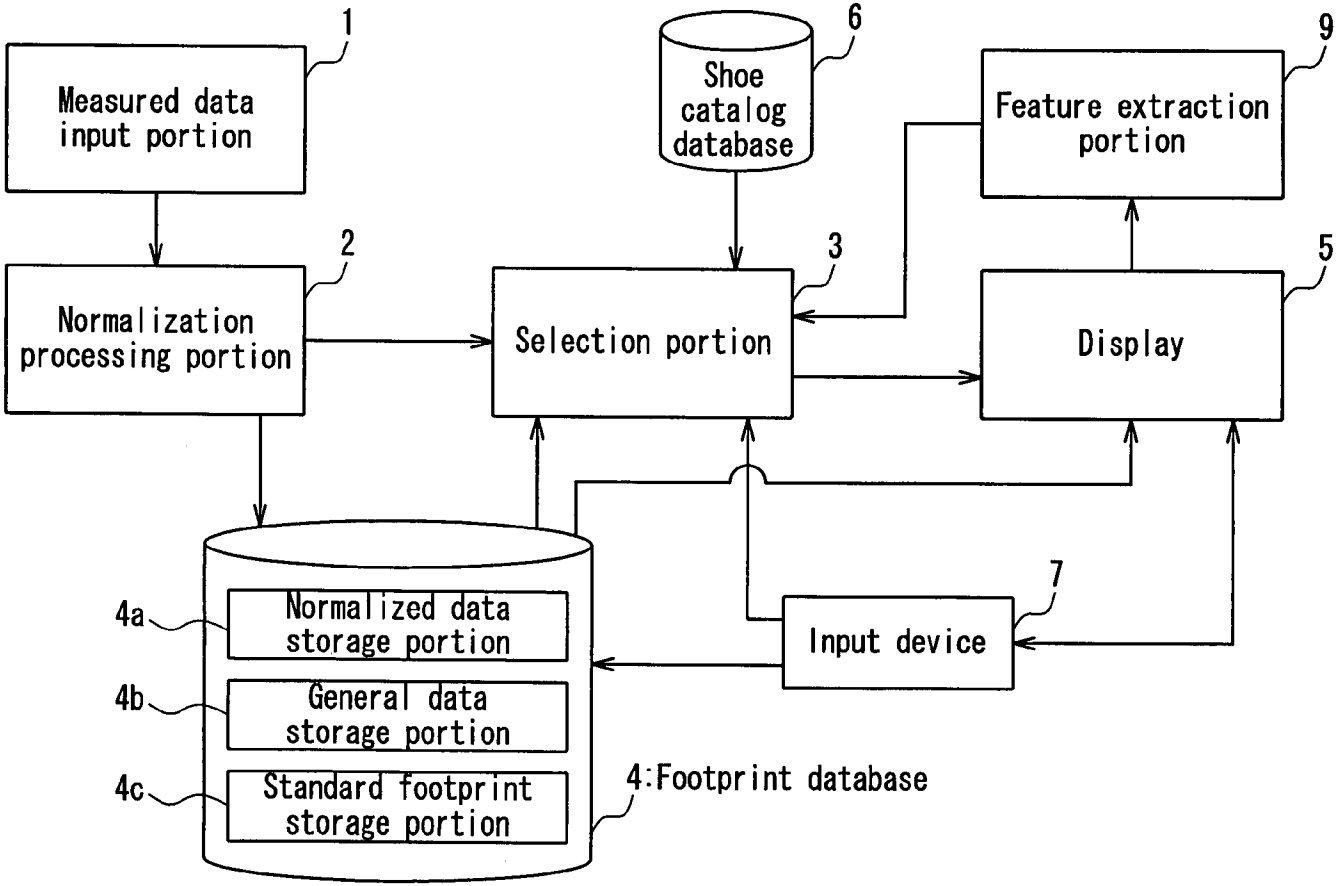
FIG. 17 is a block diagram showing the schematic configuration of a shoe selection assisting system of Embodiment 4 of the present invention.

FIG. 17 is a block diagram showing the schematic configuration of a shoe selection assisting system of this embodiment. As shown in FIG. 17, the shoe selection assisting system of this embodiment includes a feature extraction portion 9 in addition to the configuration of the shoe selection assisting system of Embodiment 1.

In the shoe selection assisting system of this embodiment, the normalized data obtained from the normalization processing portion 2 is displayed as an image on the display 5, and a clerk, a shoe fitter, or the customer oneself (operator) performs input operations on the image of the normalized data to determine a feature value needed for the estimation of a foot type. In the shoe selection assisting system, therefore, the display 5 is provided as a display (display and input portion) compatible with GUI (graphical user interface), and when any point on the screen is designated by the input device 7 (e.g., pointing device), the coordinates of the point can be identified. In addition to the designation of the coordinates, operating instructions, e.g., for drawing a straight line on the screen also can be input by controlling the input device 7.

The feature extraction portion 9 determines a feature value to estimate the foot type of the customer based on the coordinates of the point designated on the screen by the input device 7. The feature value is then transmitted to the selection portion 3. The selection portion 3 estimates the foot type of the customer in accordance with the feature value, and selects appropriate shoes.

A procedure for selecting shoes in the shoe selection assisting system of this embodiment will be described by way of a specific example.

First, as described in Embodiment 1, the measured data input portion 1 measures the state of a sole on the ground while a customer is standing. Then, the normalization processing portion 2 normalizes the result of the measurement and produces a normalized footprint. The normalized footprint is displayed as a footprint image on the display 5 while stored in the normalized data storage portion 4*a*.

In this case, a clerk, a shoe fitter, or the customer oneself (operator) draws a tangent on both inside and outside of the normalized footprint on the display 5 by using the input device 7.

Figure 18A:
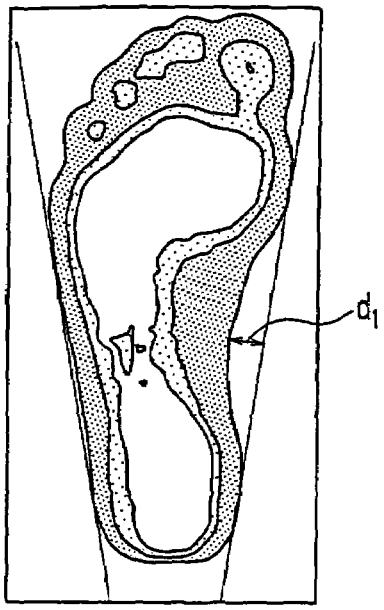
FIGS. 18A and 18B show how to extract a feature quantity of arch height ratio from a footprint.
Figure 18B:
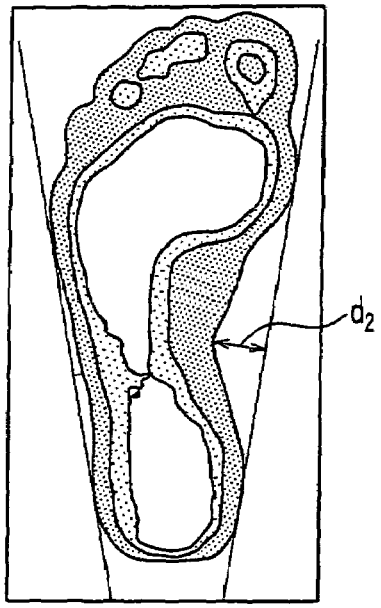

FIGS. 18A and 14B show an example of the footprint with tangents on both sides thereof. The foot type in FIG. 18A is low arch, and the foot type in FIG. 18B is high arch. Comparing FIGS. 18A and 18B, a distance $d_2$ between the tangent and the inside edge of the footprint in the midfoot portion of the high-arch foot in FIG. 18B is larger than a distance $d_1$ of the low-arch foot in FIG. 18A. The same is true for a distance between the inside tangent and the outside edge of the footprint. Thus, when such a distance is used as the "feature value", the arch height ratio can be estimated based on this feature value.

The operator designates the farthest point from the tangent on the inside edge and the outside edge of the footprint in the midfoot portion by using the input device 7. The extraction portion 9 obtains the coordinates of each of the points from the input device 7, and calculates a distance between the point on the inside edge of the footprint and the inside tangent and a distance between the point on the outside edge of the footprint and the outside tangent. The extraction portion 9 further calculates the sum of the distances and transmits it to the selection portion 3 as a feature value.

The selection portion 3 judges the foot as "high arch" when the feature value transmitted from the feature extraction portion 9 is larger than the width of the big toe of the footprint, "low arch" when the feature value is smaller than half the width of the big toe, and "medium arch" when the feature value is between these ranges.

Figure 19A:
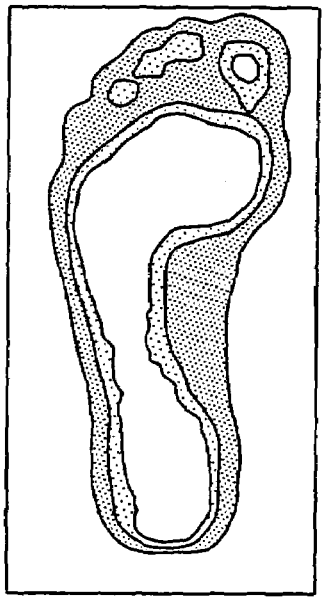
FIGS. 19A and 19B show how to extract a feature quantity of arch rigidity from a footprint.
Figure 19B:
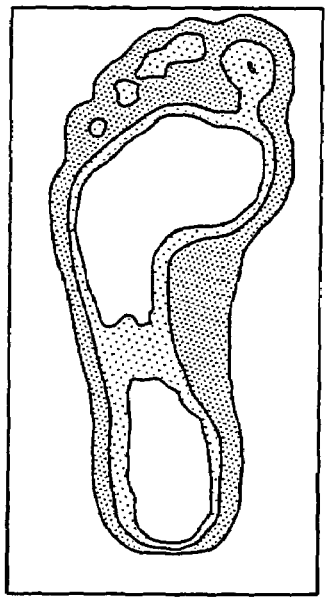

Next, the operator specifies the perimeter of an area of the normalized footprint on the display 5 that comes into contact with a measuring plane (glass surface or pressure detection surface) of the measured data input portion 1 by using the input device 7. FIG. 19A shows an example of the footprint of a soft foot. FIG. 19B shows an example of the footprint of a hard foot. For the soft foot, the area in contact with the measuring plane forms a single continuous area that connects the forefoot portion and the rearfoot portion. For the hard foot, however, the area is divided into two parts between the forefoot portion and the rearfoot portion. Therefore, the feature extraction portion 9 transmits information showing the continuity of the perimeter of the area specified by the input device 7 to the selection portion 3 as a feature value.

The selection portion 3 judges the foot as "soft" when the feature value transmitted from the feature extraction portion 9 indicates "continuation", "hard" when the feature value indicates "complete separation", "medium" when the feature value indicates neither of them (i.e., the areas are "in contact with" each other).

Figure 20C:
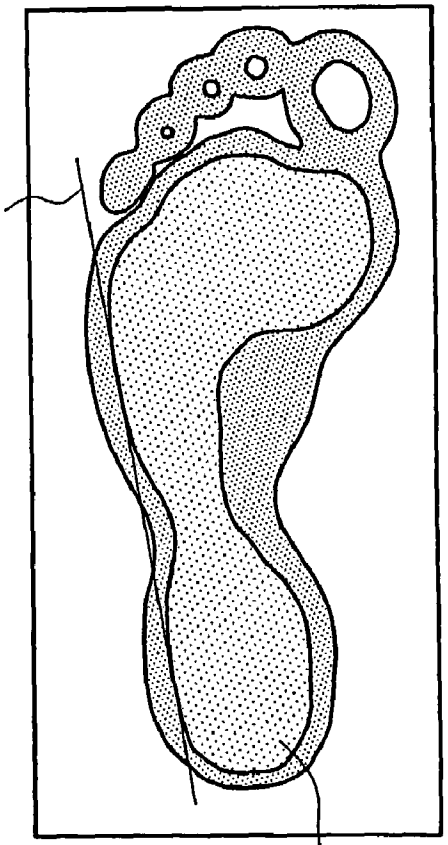
FIG. 20C illustrates a high-arch foot.
Figure 20B:
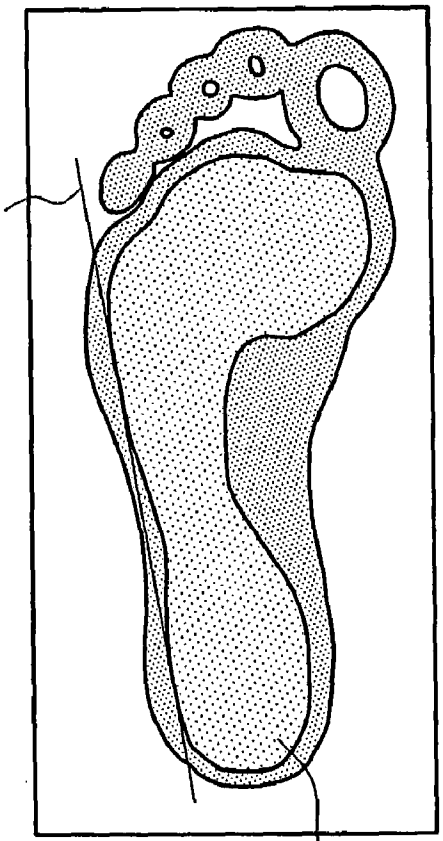
FIGS. 20A to 20B show a method for estimating an arch height ratio from a footprint.
Figure 20A:
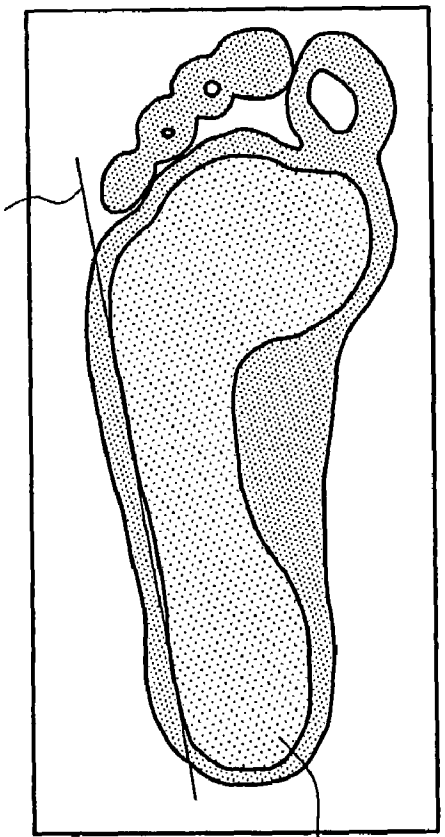

The estimation of a foot type is not limited to the above method. For example, the selection portion 3 also can estimate the arch height ratio in the following manner. As shown in FIGS. 20A to 20C, the selection portion 3 produces a line 22 that joins the outside edges of the forefoot and the heel of a footprint of a customer, and outputs the line 22 on the display 5. Then, the selection portion 3 estimates the arch height ratio by evaluating how the outside edge 21 of the footprint is positioned with respect to the line 22. The line 22 and the outside edge 21 of the footprint may be either recognized automatically by the selection portion 3 based on the brightness data, or input by the customer on the display 5 using the input device 7. As shown in FIG. 20A, when the outside edge 21 of the footprint is substantially linear and parallel to the line 22 (or the outside edge 21 protrudes from the line 22), the selection portion 3 estimates that the customer has a "low arch". As shown in FIG. 20B, when the outside edge 21 of the footprint curves slightly inward (by about half the width of the little toe) with respect to the line 22, the selection portion 3 estimates that the customer has a "medium arch". As shown in FIG. 20C, when the outside edge 21 of the footprint curves significantly inward (by more than half the width of the little toe) with respect to the line 22, the selection portion 3 estimates that the customer has a "high arch". In this case, the "little toe width" used as a criterion of the selection portion 3 may be measured and input by the operator (clerk, etc.) using the input device 7.

Figure 21A:
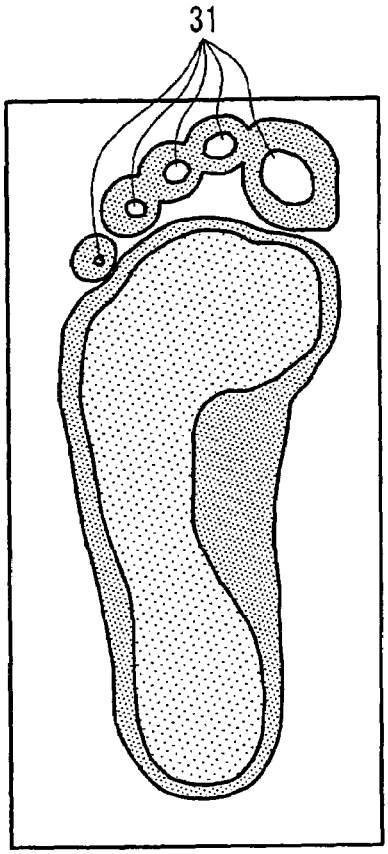
FIGS. 21A and 21B show a method for estimating arch rigidity from a footprint.
Figure 21B:
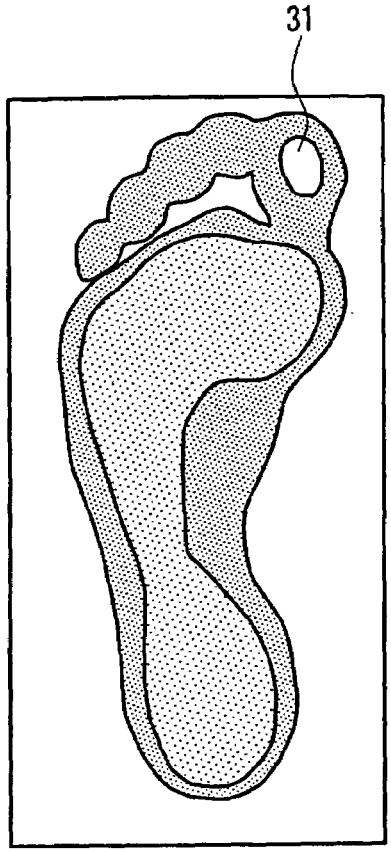

Moreover, the selection portion 3 also can estimate the arch rigidity in the following manner. As shown in FIGS. 21A and 21B, the selection portion 3 judges whether an area 31 in close contact with a glass surface is present in each toe of the footprint that is displayed on the display 5 based on the brightness data. When there is an area 31 in all the toes of the footprint as shown in FIG. 21A, the selection portion 3 estimates that the customer has "soft" feet. When the second to fifth toes come off the ground (there is no such an area 31) as shown in FIG. 21B, the selection portion 2 estimates that the customer has "hard" feet.

As described above, the selection portion 3 of this embodiment estimates the foot type of a customer in accordance with a feature value that is extracted by the feature extraction portion 9 based on the coordinates or the like designated by an operator using the input device 7. A method for selecting shoes that fit the estimated foot type has been described in Embodiment 1 and will not be repeated.

In the above specific example, the feature values for the arch height ratio and the arch rigidity are extracted from the same normalized footprint. However, the feature values may be extracted by using the sensitivity map of an arch height ratio and the sensitivity map of arch rigidity, as described in Embodiment 1.

Embodiment 5

A shoe selection assisting system of Embodiment 5 of the present invention will be described below.

Figure 22:
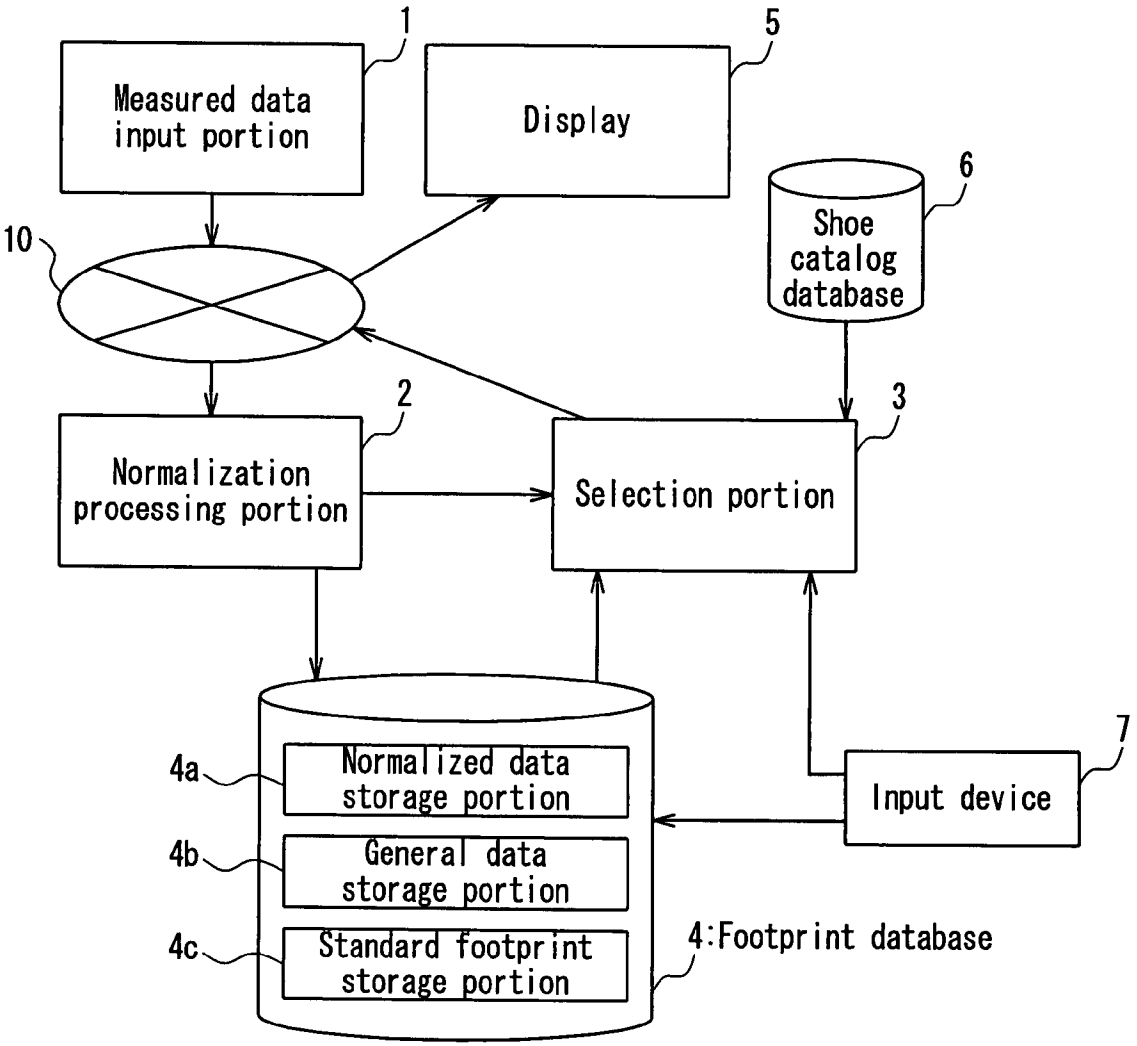
FIG. 22 is a block diagram showing the schematic configuration of a shoe selection assisting system of Embodiment 5 of the present invention.

The shoe selection assisting system of this embodiment provides a shoe selection assisting service for remote customers. In the shoe selection assisting system, therefore, the measured data input portion 1 for measuring the state of a sole on the ground while a customer is standing and the display 5 for displaying the result of shoe selection are connected to the normalization processing portion 2, the selection portion 3, the footprint database 4, the shoe catalog database 6, and the input device 7 via the Internet 10, as shown in FIG. 22. The measured data input portion 1 and the display 5 may be provided either integrally or separately as hardware. In this system configuration, when the measured data input portion 1 and the display 5 are of portable size, e.g., a shoe retailer can visit a customer or participate in an event, fair, etc. and take orders for shoes.

The operations of each portion of the shoe selection assisting system of this embodiment are the same as those in Embodiment 1 except that measured footprint data are transmitted from the measured data input portion 1 to the normalization processing portion 2 via the Internet 10, and the result of shoe selection is transmitted from the selection portion 3 to the display 5 via the Internet 10. Therefore, the same explanation will not be repeated.

In FIG. 22, the measured data input portion 1 and the display 5 are provided as a customer system. However, the normalization processing portion 2 also may be included in the customer system.

In FIG. 22, the measured data input portion 1 is neither necessarily in the off-line state, nor is required to transmit the measured data in real time. In other words, the customer may record the footprint data measured by the measured data input portion 1 on electronic recording media (CD-ROM, hard disk, DVD, etc.), and transmit the footprint data that have been recoded on the electronic recording media from the home computer or portable remote terminal via the Internet 10 as needed. When this configuration is employed, it is preferable that not only the shoe type selected, but also information about a retail store or the like where the shoes or parts for the shoe type are available is presented to the customer.

In FIG. 22, a set of the measured data input portion 1 and the display 5 are connected via the Internet 10. However, two or more sets of the measured data input portion 1 and the display 5 may share the normalization processing portion 2, the selection portion 3, the footprint database 4, the shoe catalog database 6, or the like. With this configuration, e.g., a shoe retailer having local branches can install the footprint database 4 or the like at any one of the branches or only the head office, thus enabling the shared use of the database or the like.

As described above, the shoe selection assisting system of this embodiment can select and recommend shoes suitable for the anatomical characteristics of the feet to even remote customers, thereby improving the customer service.

Each of the above embodiments does not limit the technical scope of the present invention and can be modified variously within the scope of the invention.

For example, the number of foot types for classification is not limited to the above specific examples. In view of the risk of injury, it is preferable that the foot types are classified generally into 3 to 7 groups. However, the classification number may be set appropriately in accordance with the number of types of shoes offered by shoemakers or the intended use of the shoes.

Moreover, it is also preferable that the analysis of the foot type of a customer is provided when the shoe type selected by the selection portion 3 is displayed on the display 5. The analysis may include, e.g., the footprint image, foot length, foot line, foot characteristics, foot injury history, and way of walking. Further, it is useful that care of the foot type is provided at the same time as the analysis.

The shoe type may be selected separately for a left foot and a right foot. Particularly for parts (optional parts) such as midsole, it is preferable that the foot types of both feet are estimated, and the parts that fit each of the foot types are selected accordingly.

In Embodiment 3, a display example of the standard footprint is shown in FIG. 16. In addition to this example, the standard footprint is displayed preferably as shown in FIGS. 23 to 26.

Figure 23:
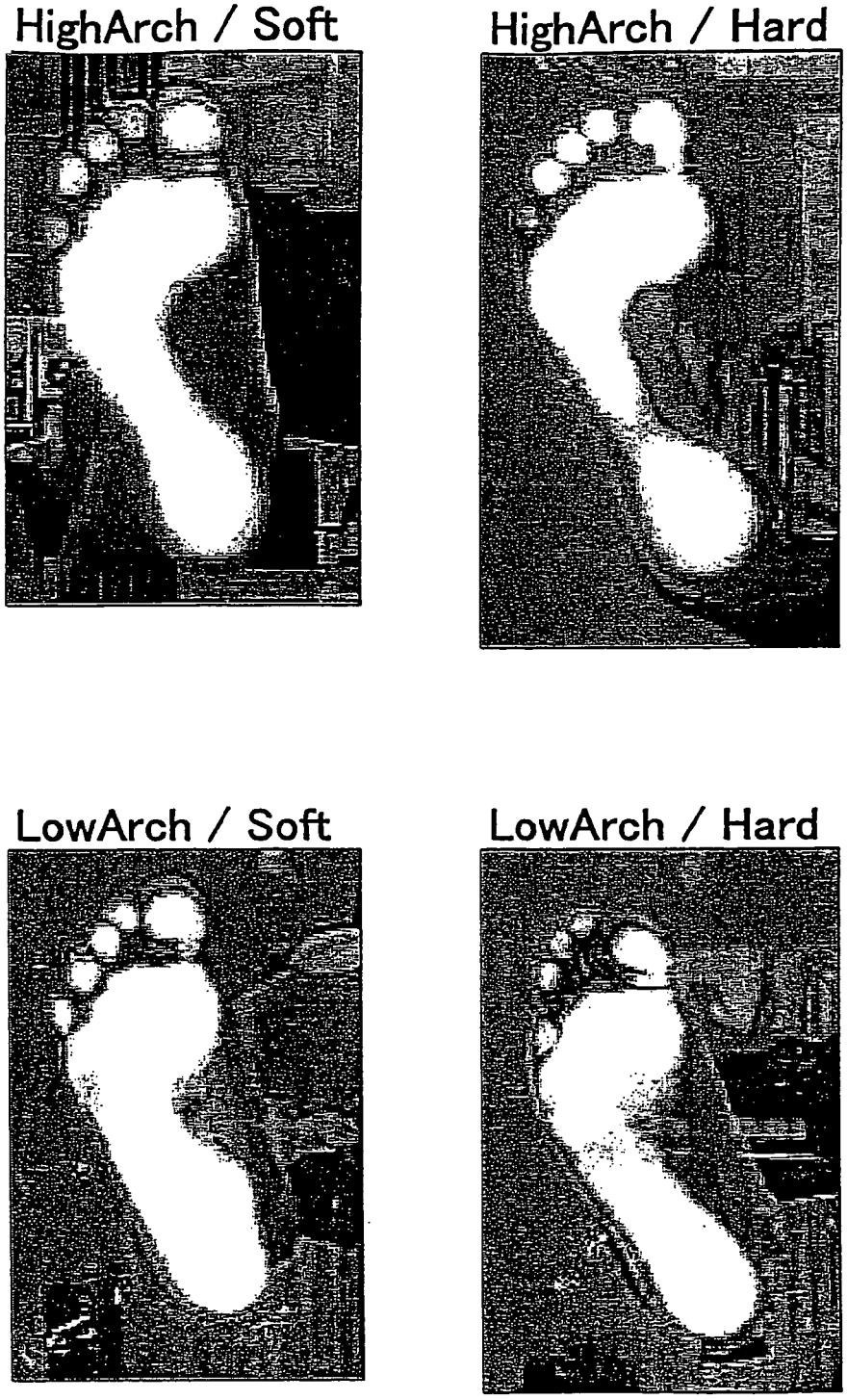
FIG. 23 shows how the foot type-specific standard footprints are displayed on a screen in the shoe selection assisting system of Embodiment 3 of the present invention.
Figure 24:
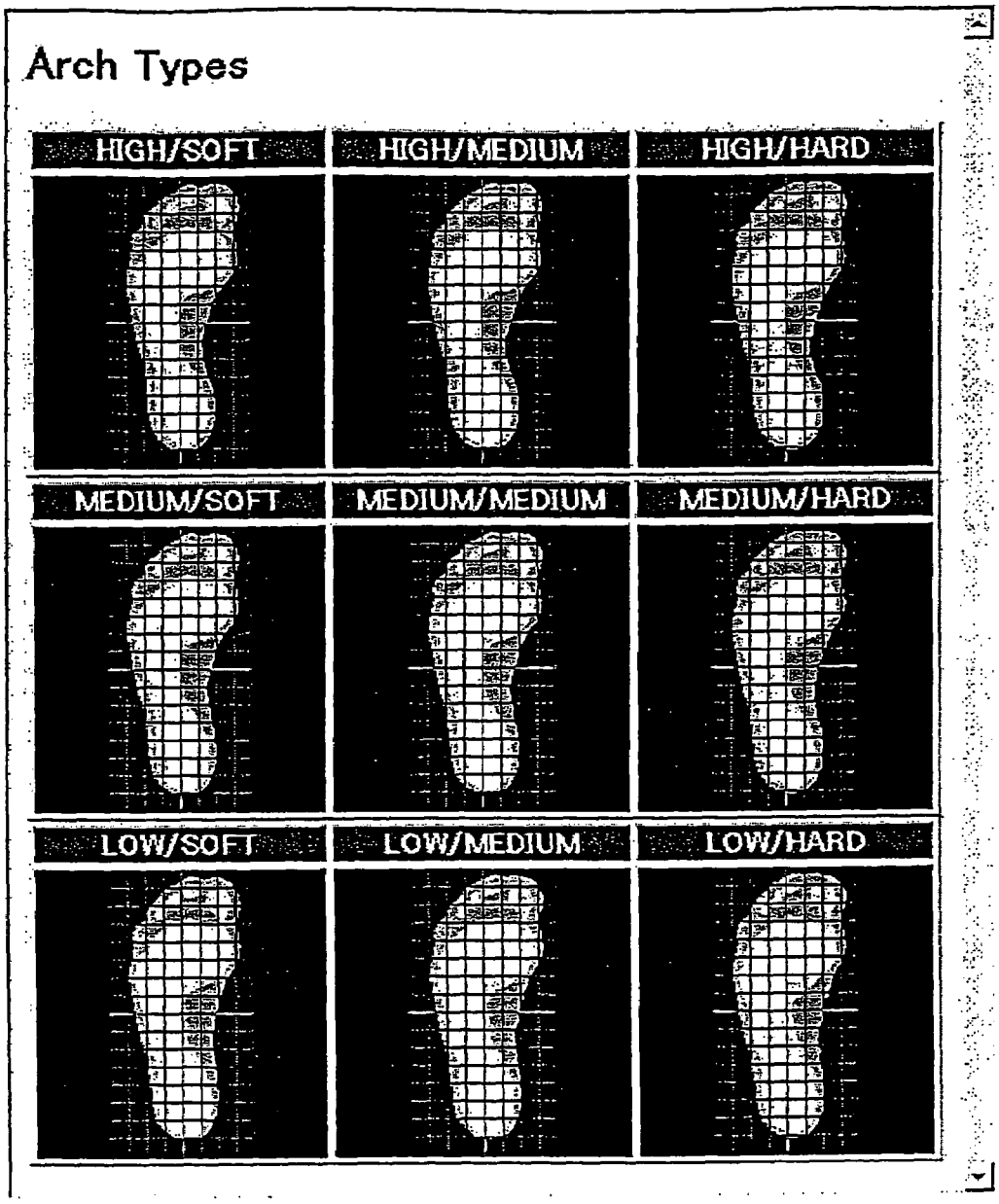
FIG. 24 shows how the foot type-specific standard footprints are displayed on a screen in the shoe selection assisting system of Embodiment 3 of the present invention.

FIG. 23 shows an example of the foot types that are classified into four categories. In the photograph of FIG. 23, a typical footprint for each of the foot types before normalization (i.e., the image in its original state as measured) is displayed on the display 5. FIG. 24 shows an example of the foot types that are classified into nine categories. In the photograph of FIG. 24, the standard footprints for each of the foot types are displayed on the display 5 with vertical and horizontal scales (grids). When the footprints are displayed with scales as shown in FIG. 24, the dimensions of each region of the sole (e.g., the width of the midfoot, the width of the big toe or little toe, or the width of the arch portion in contact with the ground) can be read easily.

Figure 25:
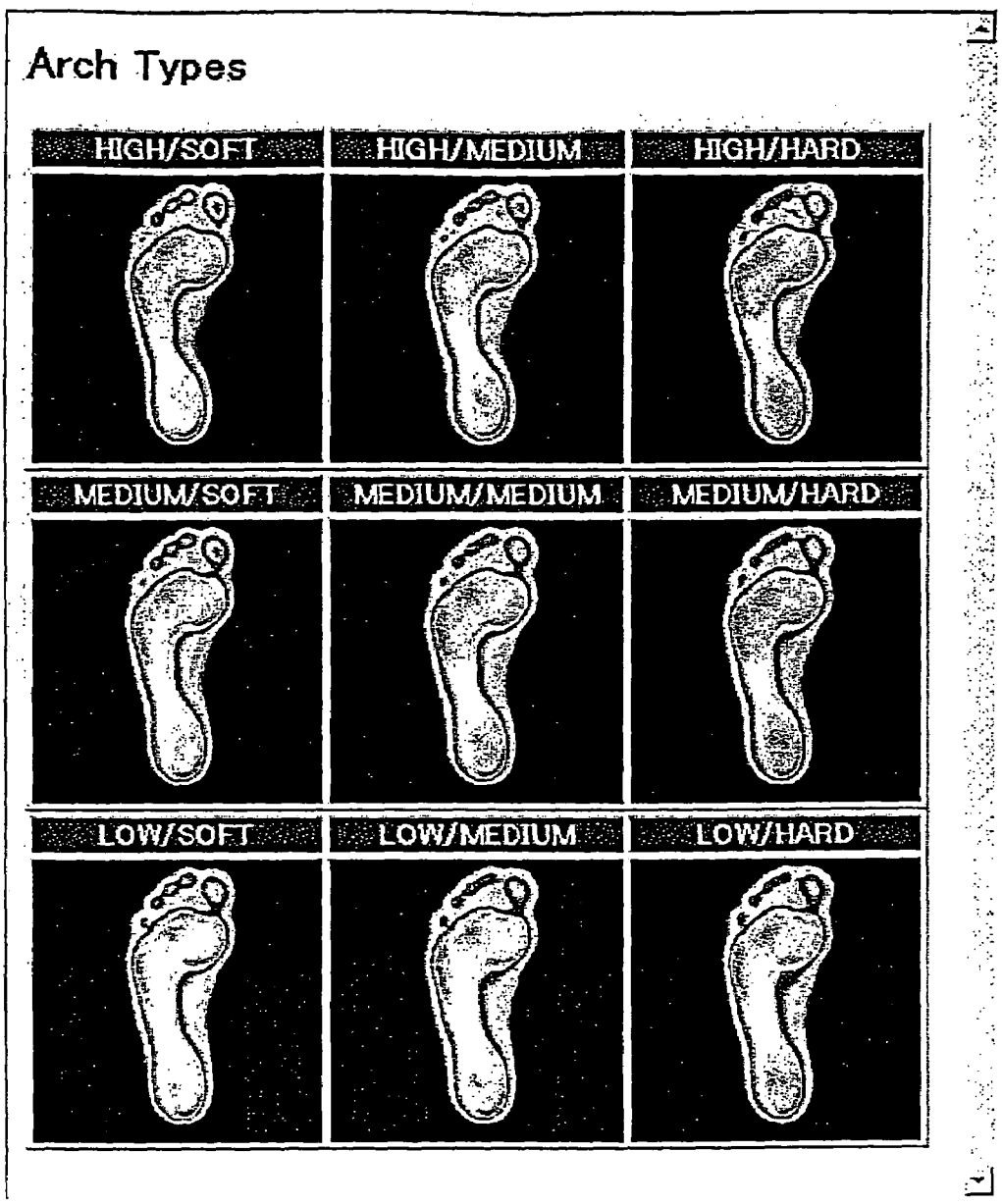
FIG. 25 shows how the foot type-specific standard footprints are displayed on a screen in the shoe selection assisting system of Embodiment 3 of the present invention.

FIG. 25 shows an example of the foot types that are classified into nine categories. In the photograph of FIG. 25, the standard footprints for each of the foot types are displayed on the display 5 so that the edge of the regions that differ in the state of the sole on the ground is emphasized to clearly distinguish the boundary between the regions. Although FIG. 25 is described in monotone, color-coding may be used for each boundary, or the edge portions may be colored.

Figure 26:
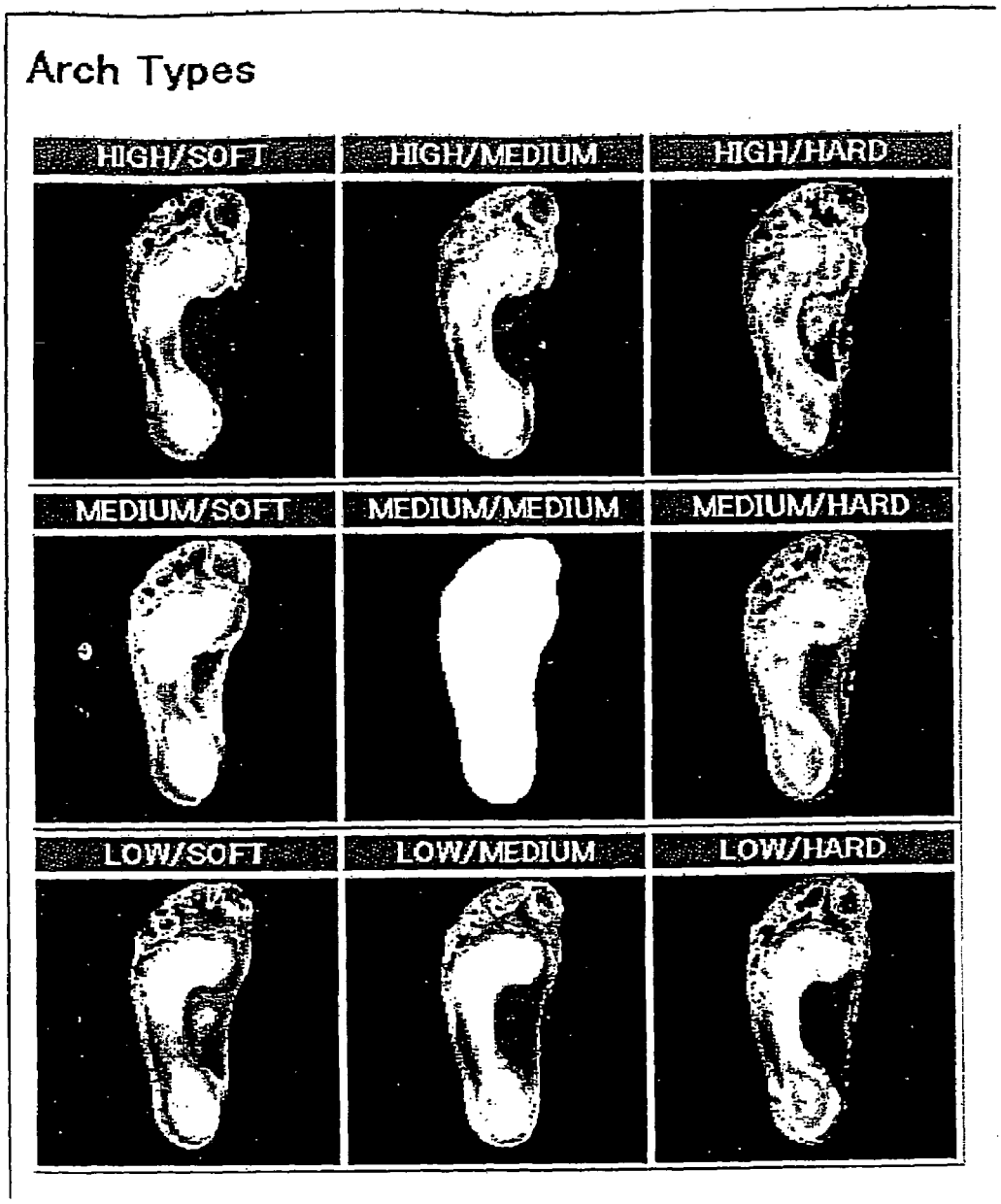
FIG. 26 shows how the foot type-specific standard footprints are displayed on a screen in the shoe selection assisting system of Embodiment 3 of the present invention.

FIG. 26 shows an example of the foot types that are classified into nine categories. In the photograph of FIG. 26, a difference in brightness per pixel between the standard footprint for each of the foot types in FIG. 25 and the standard footprint of the foot type with "medium arch" and "medium" rigidity (i.e., the MEDIUM/MEDIUM type in the center of FIG. 25) is calculated, and the image of pixels, each of which reflects the brightness difference, is displayed on the display 5. Although FIG. 26 is described in monotone, it is preferable that each pixel is displayed in different colors that change with the magnitude of the brightness difference. This makes it easier to understand a difference between the foot type with "medium arch" and "medium" rigidity and the other foot types. When the standard footprints in FIG. 26 are used, a difference in brightness per pixel between the footprint of a customer and the standard footprint of the foot type with "medium arch" and "medium" rigidity (the foot print in the center of FIG. 25) is calculated, and the image of pixels, each of which reflects the brightness difference, is used as the sole image of the customer.

Embodiment 6

A shoe selection assisting system of Embodiment 6 of the present invention will be described below.

In Embodiments 1 to 5, the anatomical characteristics of a foot are estimated by measuring the state of the sole of the foot on the ground. The shoe selection assisting system of this embodiment differs from each of the above embodiments in that the anatomical characteristics of a foot are estimated by measuring the three-dimensional shape of the foot.

Figure 27:
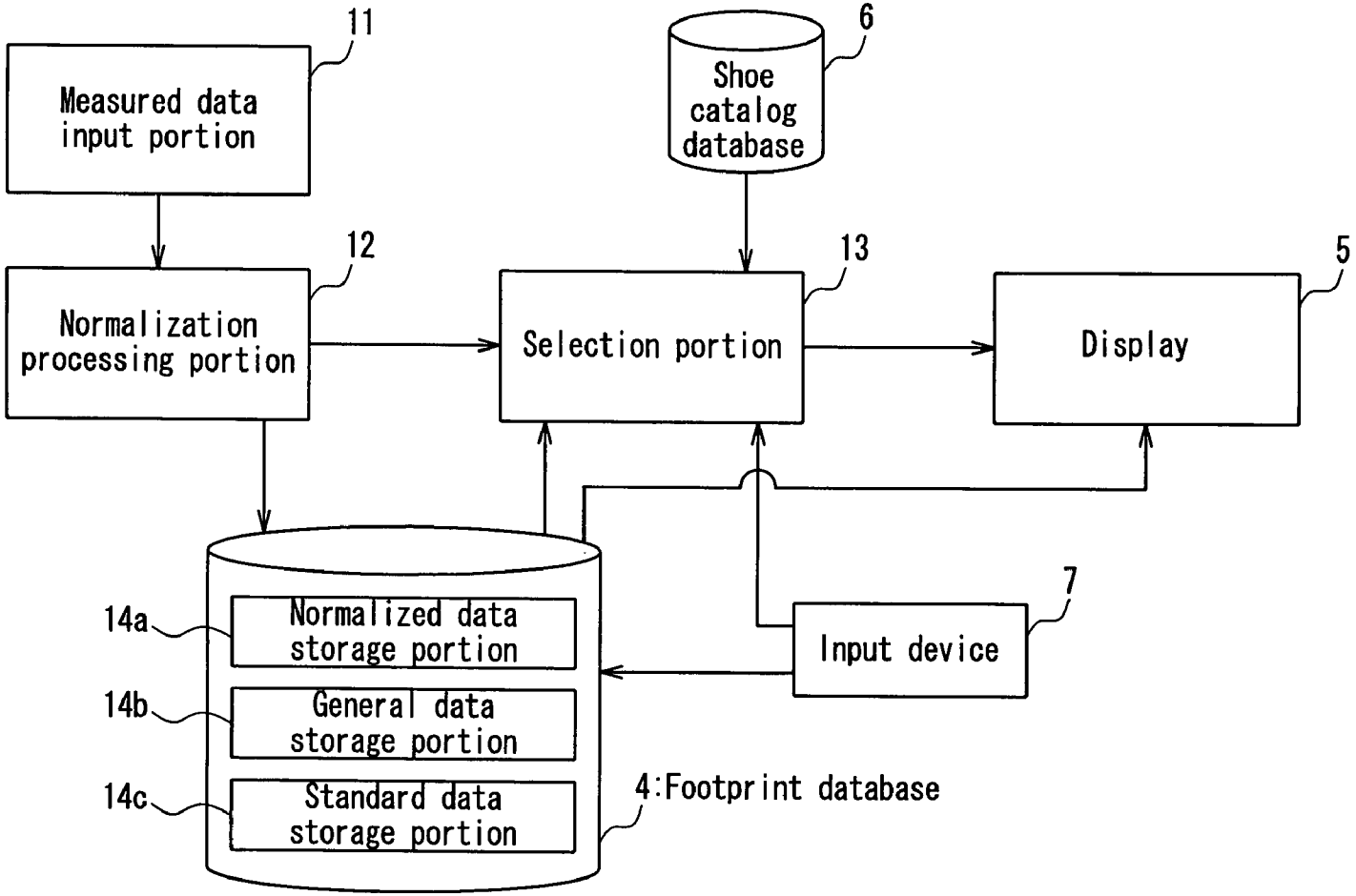
FIG. 27 is a block diagram showing the schematic configuration of a shoe selection assisting system of Embodiment 6 of the present invention.

Therefore, as shown in FIG. 27, the shoe selection assisting system of this embodiment includes a measured data input portion 11, a normalization processing portion 12, a selection portion 13, a foot information database 14, the display 5, the shoe catalog database (shoe information storage portion) 6, and the input device 7. The identical elements to those in Embodiment 1 or the like are denoted by the same reference numerals, and the detailed explanation will not be repeated.

Figure 28A:
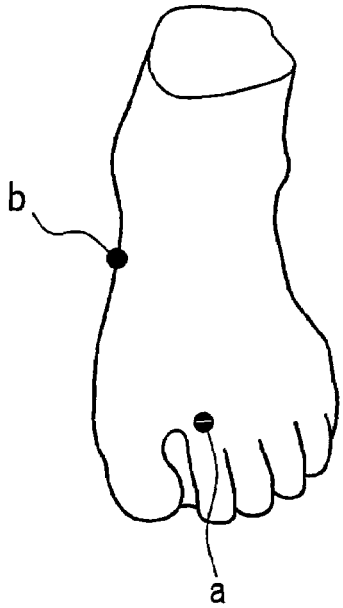
FIGS. 28A and 28B are front views showing an example of positions to which markers are attached in measuring a foot shape in Embodiment 6.
Figure 28B:
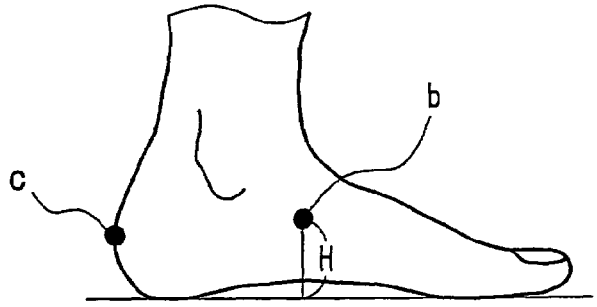

The measured data input portion 11 includes a plurality of optical sensors such as CCD cameras or digital cameras, and measures the three-dimensional shape of the foot of a person to be measured (customer) by taking pictures of the foot from different directions with the optical sensors. It is preferable that some markers are attached to the positions of the foot from which the dimensions showing the characteristics of the foot are measured. For example, when a foot length L and a navicular tuberosity height H are measured as the dimensions showing the characteristics of the foot, as shown in FIGS. 28A and 28B, markers may be attached to at least two points: a second metatarsal head a (the base of the second toe), and a navicular head b (the projection under the medial malleolus).

The three-dimensional shape data of the foot may be acquired as either polygon data that show the whole surface shape of the foot or three-dimensional data that show only the positions of the markers and the contour of the foot. The measured data input portion 11 further measures the dimensions showing the characteristics of the foot based on the resultant three-dimensional shape data.

Figure 28C:
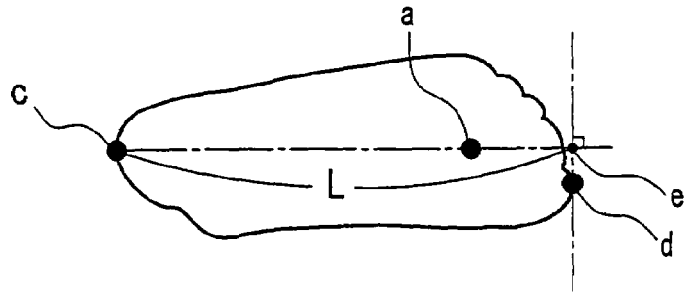
FIG. 28C is a diagram for explaining a method for measuring a foot length L in Embodiment 6.

For example, the foot length L can be determined in the following manner. As shown in FIG. 28C, first, the rearmost point c of the heel, which is farthest from the second metatarsal head a, is determined. Then, a line that passes through the two points a, c and a line that contains the tip d of the longest toe and extends perpendicular to this line are determined, respectively. Further, an intersection point e of the two lines is determined. The foot length L is a distance between the intersection point e and the rearmost point c. FIG. 28C is an image of the foot of the person when viewed from the instep side. A method for measuring the foot length L is not limited to this example. The navicular tuberosity height H can be determined by measuring a distance from the floor to the navicular head b, as shown in FIG. 28B.

The foot length L and the navicular tuberosity height H may be measured automatically by utilizing, e.g., a brightness difference between the foot portion (marker portion) and the background of the image taken by the optical sensors. Alternatively, the result of the measurement with the optical sensors may be displayed on the display 5 so that a clerk, a shoe fitter, or the customer oneself (operator) performs input operations to determine a feature value needed for the estimation of a foot type. For the latter, the display 5 is provided as a display (display and input portion) compatible with GUI (graphical user interface), and when any point on the screen is designated by the input device 7 (e.g., pointing device), the coordinates of the point can be identified. To measure the navicular tuberosity height H, e.g., an image taken from the side of the foot is displayed on the display 5, as shown in FIG. 28B. Then, the operator designates two points, i.e., the marker of the navicular head b and the intersection point of a perpendicular line from the navicular head b and the floor by using the pointing device. Thus, the navicular tuberosity height H can be obtained from the designated coordinates.

The measured data input portion 11 can measure either or both of the person's feet. In the case of both feet, it is possible to measure one foot at a time or both feet simultaneously.

In this embodiment, the arch height and the arch rigidity are examined by measuring the foot length L and the navicular tuberosity height H under two different conditions: non-weight-bearing conditions, and weigh-bearing conditions. The non-weight-bearing measurement may be performed while the person is sitting in a chair or the like. The weight-bearing measurement may be performed while the person is standing. In the following, the foot length and the navicular tuberosity height under the non-weight-bearing conditions are represented by $L_N$ and $H_N$, respectively. Similarly, the foot length and the navicular tuberosity height under the weight-bearing conditions are represented by $L_L$ and $H_L$, respectively. When more weight should be placed on the feet for special-purpose shoes such as sports shoes, the person may be measured in various states, e.g., bending the knees or standing on one leg.

Figure 29:
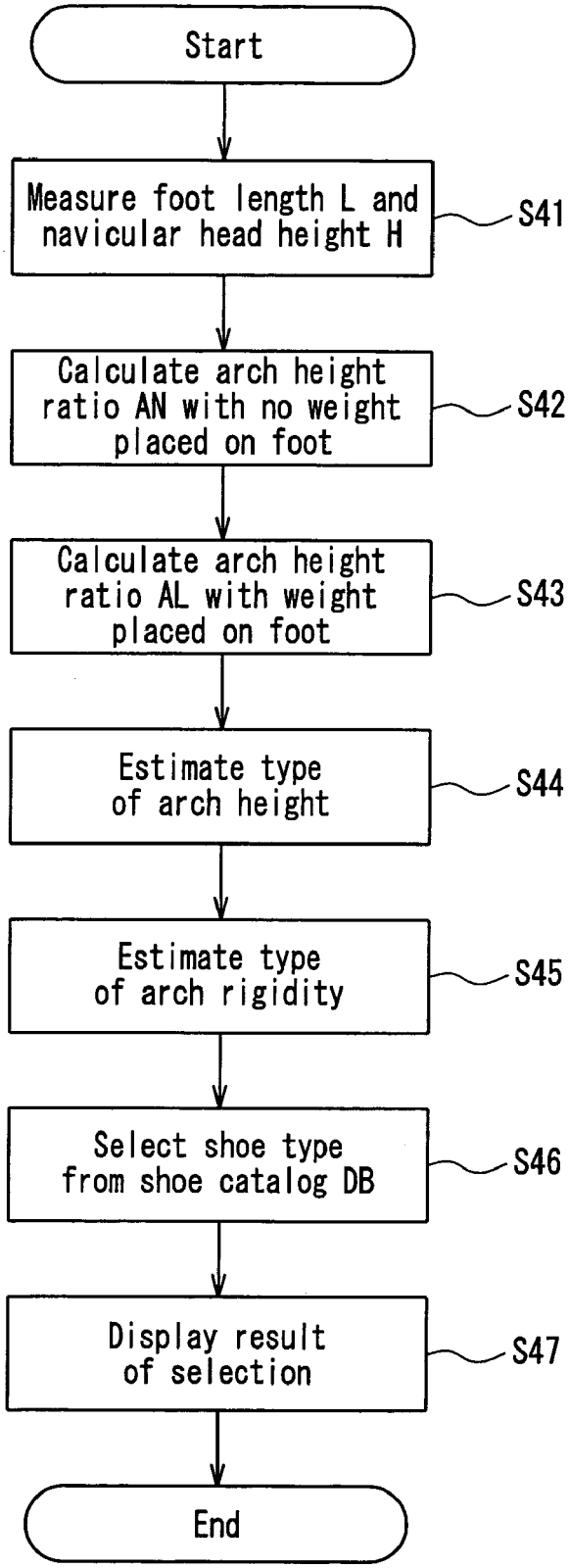
FIG. 29 is a flow chart showing operations of the shoe selection assisting system of Embodiment 6.

The operations of a shoe selection assisting system of this embodiment will be described by referring to FIG. 29.

First, as described above, the measured data input portion 11 measures a foot length L and a navicular tuberosity height H under the non-weight-bearing and weight-bearing conditions (step S41).

The measurements ($L_N$, $H_N$, $L_L$, and $H_L$) are transmitted from the measured data input portion 11 to the normalization processing portion 12. The normalization processing portion 12 normalizes the data input from the measured data input portion 11, and stores the normalized data at least temporarily (step S42).

In the step S42, the normalization processing portion 12 determines an arch height ratio $A_N$ under the non-weight-bearing conditions using the foot length $L_N$ and the navicular tuberosity height $H_N$. The arch height ratio $A_N$ is calculated by $H_N/L_N$. The arch height ratio $A_N$ is transmitted from the normalization processing portion 12 to the foot information database 14, and then is stored in the normalized data storage portion 14*a*.

When the arch height ratio is stored in the normalized data storage portion 14*a*, various data concerning the customer (e.g., the name, address, telephone number, e-mail address, purchasing history, preference for shoes, or foot injury history) may be input from the input device 7 and stored in the general data storage portion 14*b* of the foot information database 14 so as to have a correspondence with the arch height ratio of the customer.

Next, the normalization processing portion 12 determines an arch height ratio $A_L$ under the weight-bearing conditions using the foot length $L_L$ and the navicular tuberosity height $H_L$ that have been measured in the step S41 (step S43). The arch height ratio $A_L$ is calculated by $H_L/L_L$. The arch height ratio $A_L$ is transmitted from the normalization processing portion 12 to the foot information database 14, and then is stored in the normalized data storage portion 14*a*.

Next, the selection portion 13 calculates a deviation from the following formula with the weight-bearing arch height ratio $A_L$ in the step S43, and decides a foot type of the person (customer) for the arch height ratio based on the resultant deviation (S44).

$$\text{Deviation}=50+10\times(A_L-M_A)/SD_A$$

In this formula, $M_A$ represents a mean value obtained from the arch height ratios (weight-bearing conditions) of an appropriately selected population, and $SD_A$ represents a standard deviation of the arch height ratios (weight-bearing conditions) of the population. It is preferable that populations consisting of people by specific properties such as gender, age, race, and sports are used as the population. The arch height ratios of the population may be stored in the standard data storage portion 14*c* of the foot information database 14. Alternatively, only the mean value $M_A$ and the standard deviation $SD_A$ of the arch height ratios of the population may be stored in the standard data storage portion 14*c*.

The selection portion 13 judges the arch height type as "medium" when the deviation is 40 to 60, "low arch" when the deviation is less than 40, and "high arch" when the deviation is more than 60. However, such a method for judging the arch height type is merely an example, and the number of types for classification or the threshold values are not limited thereto. The selection portion 13 temporarily stores the arch height type as the result of the judgment.

Subsequently, the selection portion 13 decides an arch rigidity type based on the arch height ratios $A_N$ and $A_L$ that have been obtained in the steps S42 and S43, respectively (step S45).

In the step S45, the selection portion 13 may decide the arch rigidity type, e.g., in the following manner. First, a ratio K (hereinafter, referred to as "arch retention ratio") of the weight-bearing arch height ratio $A_L$ to the non-weight-bearing arch height ratio $A_N$ is calculated ($K=A_L/A_N$).

When the weight-bearing arch height ratio $A_L$ and the arch retention ratio K are mapped in a two-dimensional coordinates by plotting $A_L$ as the X-axis and K as the Y-axis, they are distributed around a linear function Y=aX+b (a, b are constants). To normalize the arch retention ratio K, the selection portion 13 calculates $$K_{STD}=K-(a\times A_L+b).$$

Then, the selection portion 13 calculates a deviation from the following formula with the normalized arch retention ratio $K_{STD}$, and decides an arch rigidity type based on the resultant deviation.

$$\text{Deviation}=50+10\times(K_{STD}-M_K)/SD_K$$

In this formula, $M_K$ represents a mean value of the arch retention ratios of an appropriately selected population, and $SD_K$ represents a standard deviation of the arch retention ratios of the population. The arch retention ratios of the population may be stored in the standard data storage portion 14*c* of the foot information database 14. Alternatively, only the mean value $M_K$ and the standard deviation $SD_K$ of the arch retention ratios of the population may be stored in the standard data storage portion 14*c*.

The selection portion 13 judges the arch rigidity type as "medium" when the deviation is 40 to 60, "soft" when the deviation is less than 40, and "hard" when the deviation is more than 60. However, such a method for judging the arch rigidity type is merely an example, and the number of types for classification or the threshold values are not limited thereto. The selection portion 13 temporarily stores the arch rigidity type as the result of the judgment.

By performing the steps S41 to S45, the selection portion 13 classifies the anatomical characteristics of the foot of the person into three types of "high arch", "medium arch", and "low arch (flatfoot)" according to the "arch height ratio (arch height) and further into three types of "hard", "medium", and "soft" according to the "arch rigidity (foot flexibility)". In this embodiment, therefore, the foot of the person can be classified as any one of 3×3=9 types depending on the combination of the arch height ratio and the arch rigidity.

A method for classifying the anatomical characteristics of the foot in the present invention is not limited to the above specific example, and they may be classified by any characteristics that can be estimated from the state of the foot. For example, the classification may be performed according to only the arch height ratio in the steps S41, S43, and S44. Alternatively, the classification may be performed according to only the arch rigidity by skipping the step S44.

In this embodiment, the selection portion 13 selects a shoe type that fits the person from the shoe catalog database 6 based on the arch height ratio that has been decided in the step S44 and the arch rigidity that has been decided in the step S45 (step S46), and then displays the result of the selection on the display 5 (step S47). The selection portion 13 may select either only one type of shoes that are expected to best fit the customer or a plurality of types of shoes, and outputs them for display.

A method for selecting a shoe type (e.g., shoe type or optical parts) by the selection portion 13 is the same as the selection portion 3 that has been described in Embodiment 1, and the detailed explanation will not be repeated.

As described above, the data concerning the three-dimensional shape of the foot are measured, and the anatomical characteristics of the foot are estimated based on the result of the measurement. Therefore, this embodiment can assist effectively in selecting shoes according to the foot type.

As with Embodiment 5, the shoe selection assisting system of this embodiment may have a configuration in which, e.g., the measured data input portion 11 or the display 5 is connected to, e.g., the normalization processing portion 12, the selection portion 13, the foot information database 14, the shoe catalog database 6, or the input device 7 via the Internet or the like.

In each of the above embodiments, the present invention is carried out as a shoe selection assisting system. However, the present invention also can be carried out as a computer program, a recording medium that records the computer program, or a program product. That is, not only a program including instructions that allow a computer to execute the processes as described in the above embodiments, but also a recording medium (program product) that records the program is an embodiment of the present invention.

Thus, the present invention can provide a shoe selection assisting system that can select and present a shoe type that fits a customer by estimating the anatomical characteristics of a foot from the measurement of the state of the foot.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

The invention claimed is:

1. A system for assisting shoe selection comprising:

a measured data input portion for measuring and inputting data that show a state of a foot of a person to be measured;

a normalization processing portion for normalizing the data input from the measured data input portion and storing the normalized data at least temporarily;

a shoe information storage portion for storing information of a plurality of types of shoes; and a selection portion for estimating anatomical characteristics of the foot of the person based on the normalized data, referring to the shoe information storage portion based on the anatomical characteristics, and selecting and presenting a shoe type that fits the person, wherein the selection portion estimates at least one selected from an arch height ratio and flexibility of the foot as the anatomical characteristics.

2. The system according to claim 1, wherein as the state of the foot of the person, the measured data input portion measures a state of a sole of the foot on a ground while the person is standing still by using at least one selected from an optical sensor and a pressure sensor.

3. The system according to claim 1, wherein as the state of the foot of the person, the measured data input portion measures a three-dimensional shape of the foot of the person by using an optical sensor.

4. The system according to claim 1, further comprising a standard data storage portion for storing standard data that show a state of a standard foot, wherein the selection portion estimates the anatomical characteristics of the foot of the person based on a comparison of the normalized data and the standard data.

5. The system according to claim 4, wherein the selection portion decides whether a load applied to a heel of the person tends to be eccentric inward or outward based on the normalized data, and selects a shoe type that fits the person by further considering the eccentric tendency.

6. The system according to claim 4, wherein the selection portion estimates both the arch height ratio and the flexibility of the foot as the anatomical characteristics, decides a risk of injury to the foot of the person based on a combination of the estimated arch height ratio and flexibility, and selects a shoe type in accordance with the risk of injury.

7. The system according to claim 6, wherein the selection portion decides an over pronation level of ankle joints of the person based on the combination of the arch height ratio and the flexibility, and selects a shoe type with higher stability as the over pronation level increases.

8. The system according to claim 6, wherein the selection portion decides an impact exposure level of ankle joints of the person based on the combination of the arch height ratio and the flexibility, and selects a shoe type with higher cushioning properties as the impact exposure level increases.

9. The system according to claim 1, wherein the selection portion estimates the anatomical characteristics of the foot of the person by multivariate analysis.

10. The system according to claim 1, wherein the selection portion estimates the anatomical characteristics of the foot of the person by using a neural network.

11. The system according to claim 5, wherein the selection portion decides the risk of injury after classification into three to seven groups.

12. The system according to claim 1, wherein the selection portion selects a shoe type that fits the person based on sole performance.

13. The system according to claim 12, wherein the sole performance is categorized by a material and/or a shape of parts that are contained in or formed on a midsole of a shoe.

14. The system according to claim 12, wherein the sole performance is categorized by a material and/or a shape of parts that constitute a midsole of a shoe.

15. The system according to claim 13, wherein the parts are in a form of a corrugated plate.

16. The system according to claim 1, wherein the selection portion selects of a shoe type that fits the person along with an insole that fits the person.

17. The system according to claim 16, wherein the selection portion selects the insole separately for a left foot and a right foot of the person.

18. The system according to claim 1, further comprising:

a characteristic input portion for inputting data concerning the person that include data showing the anatomical characteristics of the foot of the person;

a normalized data storage portion for storing the normalized data obtained from the normalization processing portion in correspondence with the anatomical characteristics input from the characteristic input portion;

a standard data generation portion for generating foot type-specific standard data that show a standard state of a sole on a ground in accordance with classification of the anatomical characteristics by using the normalized data stored in the normalized data storage portion; and a foot type-specific standard data storage portion for storing the foot type-specific standard data generated by the standard data generation portion.

19. The system according to claim 18, wherein the data concerning the person input from the characteristic input portion include as the anatomical characteristics of the foot at least one selected from the group consisting of a measured value of foot length, a measured value of navicular tuberosity height, an arch height ratio, a measured value of maximum supination angle, a measured value of maximum pronation angle, foot flexibility, an ankle joint movement range, a Q-angle value, and a valgus angle of a big toe or a little toe.

20. The system according to claim 18, further comprising a standard data presentation portion for displaying or printing the foot type-specific standard data stored in the foot type-specific standard data storage portion so that the foot type-specific standard data are compared with the normalized data obtained from the normalization processing portion.

21. The system according to claim 1, further comprising:

a display and input portion for displaying the normalized data obtained from the normalization processing portion as an image and for inputting coordinates of a point that is designated by an operator and operating instructions on the display image of the normalized data; and a feature extraction portion for determining a feature value to estimate the anatomical characteristics of the foot of the person based on the coordinates of the point designated on the display image of the normalized data by the display and input portion, wherein the selection portion estimates the anatomical characteristics of the foot of the person in accordance with the feature value that is obtained from the normalized data by the feature extraction portion.

22. The system according to claim 1, wherein at least two selected from the measured data input portion, the normalization processing portion, and the selection portion are connected via the Internet.

23. The system according to claim 1, wherein the selection portion presents a shoe type that fits the person along with information concerning the shoe.

24. The system according to claim 1, wherein the selection portion presents a shoe type that fits the person along with information concerning the anatomical characteristics of the foot of the person.

25. A method for assisting shoe selection comprising the steps of:

measuring data that show a state of a foot of a person to be measured;

normalizing the data that show the state of the foot;

estimating at least one selected from an arch height ratio and flexibility of the foot as anatomical characteristics of the foot of the person based on the normalized data; and selecting and presenting a shoe type that fits the person by referring to a shoe information storage portion based on the anatomical characteristics.

26. A program product comprising a computer program recorded on a recording medium, the computer program allowing a computer to execute the steps of:

inputting data that show a state of a foot of a person to be measured;

normalizing the data that show the state of the foot;

estimating at least one selected from an arch height ratio and flexibility of the foot as anatomical characteristics of the foot of the person based on the normalized data; and selecting and presenting a shoe type that fits the person by referring to a shoe information storage portion based on the anatomical characteristics.

* * * * *